US006022102A

United States Patent [19]

Ikkatai et al.

[11] Patent Number: 6,022,102

[45] Date of Patent: Feb. 8, 2000

[54] METHOD FOR REFILLING LIQUID INTO A LIQUID RESERVOIR CONTAINER, A LIQUID JET RECORDING APPARATUS USING SUCH METHOD, A LIQUID REFILLING CONTAINER, A LIQUID RESERVOIR CONTAINER, AND A HEAD CARTRIDGE

[75] Inventors: Masatoshi Ikkatai; Noribumi Koitabashi, both of Yokohama; Yuji Tsuruoka, Kawasaki, all of Japan

[73] Assignee: Canon Kabushiki Kaisha, Tokyo, Japan

[21] Appl. No.: 08/847,755

[22] Filed: Apr. 23, 1997

[30] Foreign Application Priority Data

Apr. 25, 1996 [JP] Japan ..... 8-105171
Apr. 11, 1997 [JP] Japan ..... 9-093949

[51] Int. Cl.[7] ..... B41J 2/175
[52] U.S. Cl. ..... 347/85
[58] Field of Search ..... 347/6, 7, 84, 85, 347/86, 87

[56] References Cited

U.S. PATENT DOCUMENTS

| | | | |
|---|---|---|---|
| 4,609,924 | 9/1986 | DeYoung | 347/88 |
| 4,967,207 | 10/1990 | Ruder | 347/7 |
| 4,968,998 | 11/1990 | Allen | 347/7 |
| 5,136,305 | 8/1992 | Ims | 347/85 |
| 5,162,817 | 11/1992 | Tajika et al. | 347/7 |
| 5,216,450 | 6/1993 | Koitabashi et al. | 347/87 |
| 5,485,187 | 1/1996 | Okamura et al. | 347/85 |
| 5,488,400 | 1/1996 | Crystal et al. | 347/85 |
| 5,509,140 | 4/1996 | Koitabashi | 347/86 |
| 5,515,663 | 5/1996 | Allgeier, Sr. et al. | 53/467 |
| 5,619,238 | 4/1997 | Higuma et al. | 347/86 |

FOREIGN PATENT DOCUMENTS

| | | | |
|---|---|---|---|
| 640484 | 8/1994 | European Pat. Off. . | |
| 674998 | 3/1995 | European Pat. Off. . | |
| 685339 | 5/1995 | European Pat. Off. . | |
| 58194560 | 11/1983 | Japan . | |
| 58194561 | 11/1983 | Japan . | |
| 59-104945 | 6/1984 | Japan . | |
| 405096744A | 4/1993 | Japan | B41J 2/175 |
| 640043 | 2/1994 | Japan . | |
| 6226990 | 8/1994 | Japan . | |
| 07-025025 | 1/1995 | Japan . | |
| 768776 | 3/1995 | Japan . | |
| 7125232 | 5/1995 | Japan . | |
| 834122 | 2/1996 | Japan . | |
| 2268911 | 1/1994 | United Kingdom . | |

OTHER PUBLICATIONS

Kelchak, J.A., "Fluid–Level Controlling Device", IBM Technical Disclosure Bulletin, vol. 24, No. 5, Oct., 1981, pp. 2264–2266.

*Primary Examiner*—N. Le
*Assistant Examiner*—Anh T. N. Vo
*Attorney, Agent, or Firm*—Fitzpatrick, Cella, Harper & Scinto

[57] ABSTRACT

A method for refilling liquid using a refilling container is to refill liquid to a liquid reserving container, which is provided with a first chamber that houses a negative pressure generating member, at the same time, having an aperture conductively connected to the outside, and with a second chamber conductively connected with the first chamber through a communicating unit for forming essentially a closed space with the exception of the communicating unit. This method comprises the step of forming an essentially closed space from the atmospheric air by means of the second chamber and the refilling container with the exception of the communicating unit in a state where the liquid surface of the refilling container is positioned higher than the liquid surface of the second chamber, and the step of arranging the second chamber to be conductively connected with the refilling container by use of a first path that enables gas in the second chamber to communicate with gas in the refilling container, and a second path, which is different from the first path, arranged for shifting liquid in the refilling container into the second chamber. With the method thus arranged, liquid in the liquid refilling container is refilled into the liquid reserving chamber quickly and stably without leakage from the aperture arranged for the first chamber.

23 Claims, 12 Drawing Sheets

METHOD FOR REFILLING LIQUID INTO A LIQUID RESERVOIR CONTAINER, A LIQUID JET RECORDING APPARATUS USING SUCH METHOD, A LIQUID REFILLING CONTAINER, A LIQUID RESERVOIR CONTAINER, AND A HEAD CARTRIDGE

BACKGROUND OF THE INVENTION

1. Field of the Invention

The present invention relates to a method for refilling liquid into a liquid reservoir container arranged on the liquid supply path of a liquid jet recording apparatus. The invention also relates to a liquid jet recording apparatus using such method, a liquid refilling container, a liquid reservoir container, and a cartridge.

2. Related Background Art

For the method for supplying liquid to a liquid jet recording apparatus that records by discharging liquid (ink) onto a recording medium, it is required to form menisci appropriately at the discharge ports of the recording head, and also, to perform a stabilized supply of liquid, among some others. As a liquid supplying method that satisfies these conditions, the applicant hereof has proposed a structure with the specification of Japanese Patent Laid-Open Application No. 7-125232 that a porous element is inserted into a part of a container (an ink tank) that contains ink.

FIG. 15 is a cross-sectional view schematically showing the structure of an ink tank that utilizes the proposed structure described above. The interior of the ink tank 1101 is divided into two spaces by means of a partition wall 1103 provided with a communicating unit 1102. One of the spaces is closed with the exception of the communicating unit 1102 of the partition wall 1103. This space is made an ink reserving chamber 1104 capable of holding liquid (ink) as it is without any other members mixedly present. The other space is made a negative pressure generating member housing chamber (an air communication type liquid containing chamber) 1106 that contains a porous negative pressure generating member 1105. On the wall surface that forms this negative pressure generating member housing chamber 1106, there are formed an air communication port 1107 for inducting the air outside along the consumption of ink, and a supply port 1108 for supplying ink to the recording head unit.

With a tank structure of the kind, the air is induced into the negative pressure generating member housing chamber 1106 through the-air communication port 1107 when ink in the negative pressure generating member 1105 is consumed as ink is discharged from the recording head. Then, ink flows into the ink reserving chamber 1104 through the communicating unit 1102 of the partition wall 1103. On the other hand, ink is filled into the negative pressure generating member 1105 in the negative pressure generating member housing chamber 1106 from the ink reserving chamber 1104 through the communicating unit 1102 of the partition wall 1103. Therefore, even when ink is consumed by the recording head, ink is filled to the negative pressure generating member 1105 in accordance with the amount of ink that has been consumed, thus allowing the negative pressure generating member 1105 to retain a specific amount of ink. In this way, the negative pressure to the recording head is kept at a substantially constant level, making it possible to stabilize the ink supply to the recording head.

Particularly, as disclosed in the specification of Japanese Patent Laid-Open Application No. 6-40043, it is possible to attain an ink supply in a better condition by making an arrangement so that a path for the air induction (an air induction groove) is provided near the unit that communicates the negative pressure generating member housing chamber with the ink reserving chamber.

For a container (an ink tank) of the kind, which is structured as described above, there is known, among others, a method for refilling ink when ink in the ink reserving chamber becomes short as disclosed in the specification of Japanese Patent Laid-Open Application No. 6-226990 filed by the applicant hereof, for example, wherein a plug is arranged in the upper part of an ink reserving chamber, and the plug is open before the amount of ink in the negative pressure generating member housing chamber becomes lower than a given amount, and then, ink is injected from the aperture thus arranged into the interior of the ink reserving chamber by use of a syringe or the like or a method for dividing the ink reserving chamber into two chambers one of which is made exchangeable, and replacing the completely used ink reserving chamber with a new one before ink in the negative pressure generating member housing chamber becomes lower than a given amount along the ink consumption.

The liquid container (an ink tank) described above satisfies ideal conditions as a method for supplying ink, and also, with the provision of such container, a stabilized liquid refilling is materialized for the suppliance of liquid to the container described above by refilling liquid before the liquid in the negative pressure generating member housing chamber becomes lower than a given amount.

However, with more ideal conditions in view as to the suppliance of liquid, it is desirable to make the numbers of locations, conditions, and the like as small as possible, and to fulfill the requirements with a simpler structure in such a manner as to make liquid suppliable while a container is installed on a recording apparatus as it is or to make liquid suppliable without restrictions on the posture of a container whose content should be refilled.

Also, as to the ink refilling operation, it is demanded not only to execute the intended refilling in a short period of time, but also, to execute it smoothly. For example, as regards the method disclosed in the specification of Japanese Patent Laid-Open Application No. 6-226990 described above, wherein an ink reserving chamber is divided into two, and one of them is made exchangeable, it is necessary to optimize the size of the aperture that connects the divided chambers in order to make the liquid refilling smoothly.

It is an object of the present invention to provide a method for refilling liquid capable of refilling liquid into a liquid reservoir container smoothly with fewer restrictions and in a shorter period of time.

It is another object of the invention to materialize the method for refilling liquid described in the preceding paragraph, and to provide at low costs a liquid jet recording apparatus, refilling kit, and the like, capable of performing stabilized liquid supplies.

SUMMARY OF THE INVENTION

In order to achieve the objects described above, the method for refilling liquid of the present invention is to use a refilling container and to refill liquid into a liquid reservoir container provided with a first chamber housing in it a negative pressure generating member, at the same time, having an aperture conductively connected to the outside, and also, provided with a second chamber arranged to communicate with the first chamber through a communicating unit and to form an essentially closed space with the exception of the communicating unit thus provided, wherein while forming a space essentially closed from the atmospheric air with the exception of the aforesaid communicating unit by use of the second chamber and the refilling container in a state where the liquid level of the refilling container is positioned higher than the liquid level of the second chamber, the second chamber and the refilling container are conductively connected by means of a first path enabling gas in the second chamber to communicate with gas in the refilling container; and the second chamber is conductively connected with the refilling container by means of a second path different from the first path to enable liquid in the refilling container to move to the second chamber.

Also the liquid jet recording apparatus of the present invention is provided with a carriage mounting on it a liquid reservoir container holding liquid, as well as with a recording head for recording on a recording medium by discharging liquid supplied from the liquid reservoir container; and a refilling container holding liquid to be refilled into the liquid reservoir container, wherein the liquid reservoir container is provided with a first chamber containing in it a negative pressure generating member, at the same time, having a supply port to supply liquid to the recording head and an air communication port as well, and the liquid reservoir container is also provided with a second chamber having a communicating unit to connect it conductively with the first chamber, and to from an essentially closed space with the exception of the communicating unit; and then, while the liquid level of the refilling container is positioned higher than the liquid level of the second chamber, the second chamber is conductively connected with the refilling container by means of a first path enabling gas in the second chamber to communicate with gas in the refilling container, and a second path different from the first path to enable liquid in the refilling chamber to move to the second chamber.

Further, the liquid refilling container of the present invention is to hold liquid to be refilled into a liquid reservoir container, and detachably mounted on the liquid reservoir container provided with a first chamber containing a negative pressure generating member, at the same time, having an aperture conductively connected with the outside, and also, provided with a second chamber conductively connected with the first chamber through a communicating unit, and forming an essentially closed space with the exception of the communicating unit, wherein the liquid refilling container is provided with a first path enabling gas in the second chamber to communicate with gas in the refilling container, and a second path different from the first path to allow liquid in the refilling container to move to the second chamber.

The liquid reservoir container of the present invention is the one whose liquid is refilled when a liquid refilling container holding liquid is mounted on it, wherein the liquid reservoir container is provided with:

a first chamber containing a negative pressure generating member, at the same time, having an aperture conductively connected with the outside;

a second chamber having a communicating unit conductively connected with the first chamber, and forming an essentially closed space with the exception of the communicating unit;

a first connecting unit provided for the second chamber to connect it with the first path arranged for the liquid refilling container in order to enable gas in the second chamber to communicate with gas in the refilling container;

a second connecting unit different from the first connecting unit provided for the second chamber to connect it with the second path arranged for the liquid refilling container in order to enable liquid in the liquid refilling container to move to the second chamber; and valve members provided for the first and second connecting units, respectively, and arranged to be open when either the first path or the second path is connected.

The cartridge of the present invention is provided with the liquid reservoir container of the present invention integrally formed by a recording head for recording by discharging onto a recording medium the liquid which is supplied from the first chamber of the liquid reservoir container.

Further, in accordance with the present invention, there are provided an integrated liquid container having a liquid reservoir container and a liquid refilling container of the present invention described above, and also, an integrated head cartridge having the integrated container and a recording head.

The present invention is to refill liquid from a refilling container into a liquid reservoir container by use of the liquid reservoir container provided with a first chamber and a second chamber, as well as by use of the refilling container. When liquid is refilled, a closed space is formed by means of the second chamber of the liquid reservoir container and the liquid refilling container with the exception of the communicating unit, thus enabling the liquid reservoir container to be conductively connected with the refilling container through the first path that enables gases in both of them to be communicated with each other, as well as through the second path different from the first path. By means of the conduction provided by the first path, the gaseous pressures in the second chamber and the refilling container are balanced, and by means of the conduction provided by the second path, liquid is automatically refilled from the refilling container to the second chamber by means of the water level difference between the second chamber and the refilling container. At this juncture, since the second chamber and the refilling container are made a closed space with the exception of the communicating unit, there is no possibility that liquid leaks from the aperture of the-first chamber of the liquid reservoir container.

Also, it may be possible to form the first path and the second path with tubes having valves or to arrange a structure so that the second chamber and the refilling container are detachably connected. If the structure is arranged by means of tubes, there is a need for the provision of closing means, such as a valve mechanism, in order to close each of the tubes to the air outside essentially when the second chamber is not connected with the refilling container.

Further, with the provision of means for detecting liquid remains for a liquid reservoir container, it is arranged to cut off the connection between the second chamber and the refilling container, which is made through the first and second paths, when the liquid level of the liquid reservoir container reaches a specific height, thus keeping the liquid amount of the liquid reserving container at a constant level after refilling or it may be possible to refill liquid into the liquid reservoir container until the liquid levels of the second chamber and refilling container reach the same height by connecting the second chamber and the refilling container substantially in the horizontal direction, while positioning the first path higher than the second path.

BRIEF DESCRIPTION OF THE DRAWINGS

FIG. 13A shows the state before the refilling tank is installed, and FIG. 13B shows the state after the refilling tank is installed.

DETAILED DESCRIPTION OF THE PREFERRED EMBODIMENTS

Now, with reference to the accompanying drawings, the description will be made of the embodiments in accordance with the present invention.

(First Embodiment)

Figure 1:
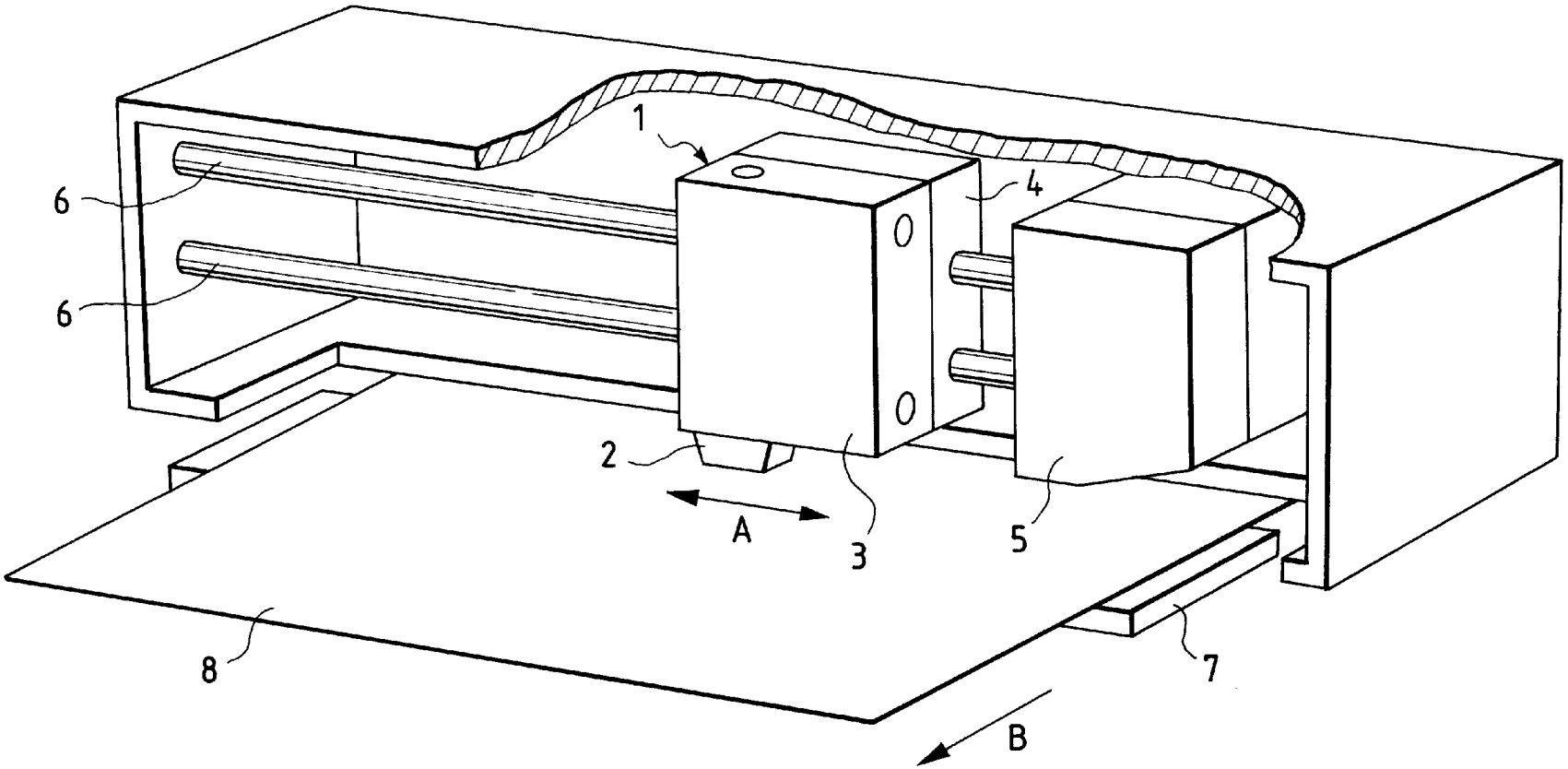
FIG. 1 is a perspective view which schematically shows a liquid jet recording apparatus illustrating a first embodiment in accordance with the present invention.
Figure 2A:
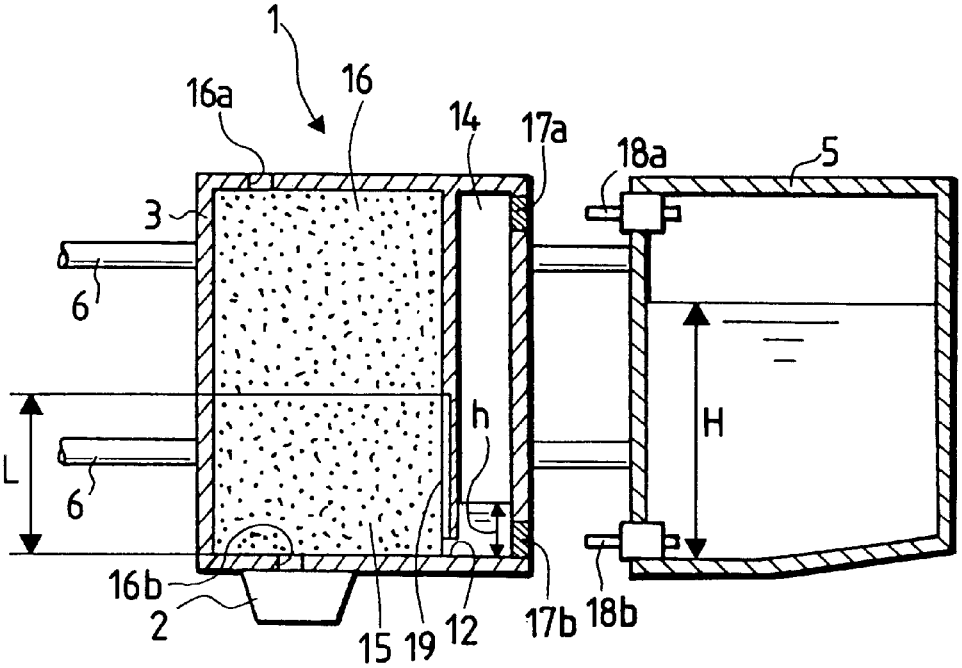
FIGS. 2A and 2B are cross-sectional views showing a reservoir tank and a refilling tank, illustrating the operation of refilling ink into the head cartridge of the liquid jet recording apparatus represented in FIG. 1.
Figure 2B:
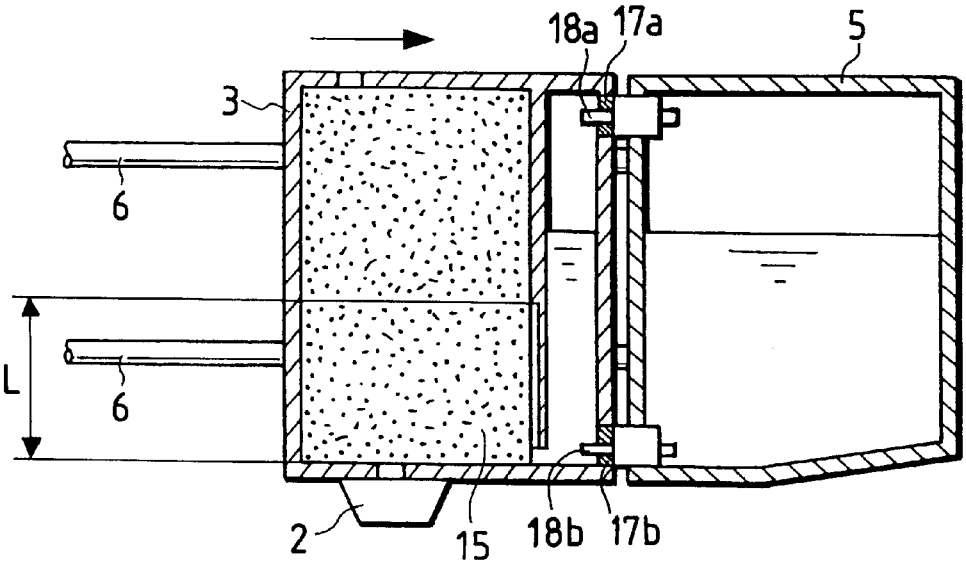

FIG. 1 is a perspective view schematically showing a liquid jet recording apparatus, illustrating a first embodiment in accordance with the present invention. FIGS. 2A and 2B are cross-sectional views showing a reservoir tank and a refilling tank, illustrating the ink refilling operation for the head cartridge of the liquid jet recording apparatus represented in FIG. 1.

As shown in FIG. 1, a carriage 4 having a head cartridge 1 mounted on it is fitted slidably in the directions indicated by arrows A (horizontal direction) on the two guide shafts 6, which are arranged in parallel to each other. The head cartridge 1 is formed integrally by a recording head 2 that discharges ink in accordance with recording signals, and a reservoir tank (liquid reservoir container) 3 for supplying ink to the recording head 2. Here, it may be possible to arrange a structure so that the recording head 2 and the reservoir tank 3 are made separable. It may also be possible to arrange them together with respect to the carriage 4. In accordance with the present embodiment, an example is shown, in which all of the related elements are integrated on the carriage 4.

The recording head 2 is provided with a plurality of nozzles for discharging ink. In each of nozzles, an electrothermal transducing element is arranged to generate thermal energy for use of ink discharges, respectively. Ink is supplied to the recording head 2 by means of capillary phenomenon taking place in each of the nozzles. Ink thus supplied forms meniscus at the leading end of each nozzle and maintains a state where each nozzle is filled with ink. When each of the electrothermal transducing elements is energized in this state, ink on the electrothermal transducing element is heated to create foaming phenomenon. By the application of energy exerted by this foaming, ink droplets are discharged from each of the nozzles.

The carriage 4 is caused to reciprocate in the directions indicated by the arrows A by means for driving the carriage (not shown). A platen 7 is arranged in a position facing nozzles of the recording head 2. A recording sheet 8 is conveyed on the platen 7 in the direction indicated by an arrow B by means for conveying recording sheets (not shown). The conveyance of the recording sheet 8 is performed intermittently at a given pitch per scan of the carriage 4. Between such intermittent conveyances of the recording sheet, recording is performed by ink discharged from the recording head 2.

Also, the maximum recording width (recording area) of the recording sheet 8 is made smaller than the scanning area of the recording head 2. Outside the range of this recording area, a refilling tank (refilling container) 5 is fixedly positioned to refill ink into the reservoir tank 3 when it engages with the reservoir tank 3.

Here, with reference to FIGS. 2A and 2B, the description will be made of the structures of the reservoir tank 3 and refilling tank 5.

Figure 15:
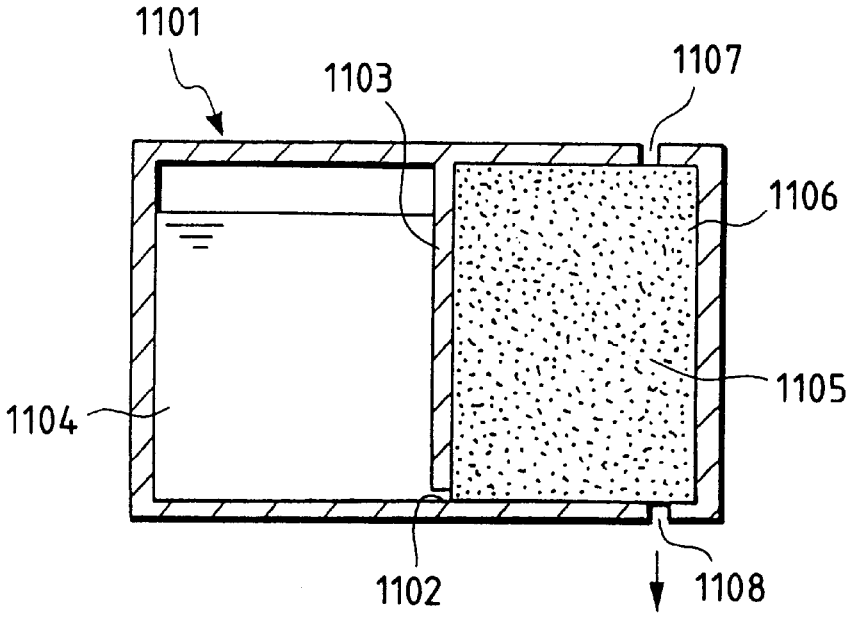
FIG. 15 is a cross-sectional view schematically showing the structure of an ink- tank having a porous element inserted into a part thereof.

The reservoir tank 3 is structured almost the same as the ink tank 1101 described earlier in conjunction with FIG. 15 except for the structure arranged to connect it with the refilling tank 5, which will be described later. In other words, as shown in FIG. 2A, the reservoir tank 3 is divided by means of a partition wall having a communicating unit 12 on the bottom thereof into a negative pressure generating member housing chamber (first chamber) 16 that holds a negative pressure generating member 15, which is a porous element, and a ink reserving chamber (second chamber) 14 that keeps ink as it is. On the wall surface that forms the negative pressure generating member housing chamber 16, there are formed an air communication port 16*a* and a supply port 16*b* for supplying ink to the recording head 2. On the other hand, on the portion of the wall surface of the ink reserving chamber 14 that faces the refilling tank 5, two holes are provided, each one at the upper and lower ends of such portion, respectively. Each of them is usually closed by valve members 17*a* and 17*b* formed by rubber or the like, respectively. Here, in accordance with the present embodiment, an air induction groove 19, such as disclosed in the specification of Japanese Patent Laid-Open Application No. 6-40043, is provided for the negative pressure generating member housing chamber 16.

The refilling tank 5 forms one chamber that holds ink in its interior. On the wall surface thereof that faces the reservoir tank, tubes 18*a* and 18*b* are installed in the positions corresponding to those of two valve members 17*a* and 17*b* of the reservoir tank 3. On each leading end of these tubes 18*a* and 18*b*, a valve mechanism (not shown), which is usually closed, is provided, but arranged to be open when inserted into the reservoir tank 3 through each of the valve members 17*a* and 17*b*. Also, each of the valve members 17*a* and 17*b* of the reservoir tank 3 is provided with the function that enables each of them to be open when the tubes 18*a* and 18*b* are inserted, respectively. In this respect, the tube 18*a* is closed when it is disconnected from the ink reserving chamber 14 as shown in FIG. 2A, thus making it possible to prevent ink leakage from the refilling tank 5. It is also preferable to keep the tube 18*b* closed when it is in a state shown in FIG. 2A, because the evaporation of ink is then made smaller from the refilling tank 5.

The amount of ink held in the refilling tank 5 at the outset is such as to enable the liquid surface of ink to be positioned lower than the upper tube 81*a* when the refilling tank 5 is postured as shown in FIG. 2A. Therefore, when ink is refilled from the refilling tank 5 into the reservoir tank 3, the upper tube 18*a* is always in contact with the air in the refilling tank 5. As a result, no ink is refilled from the tube 18*a*, but only from the lower tube 18*b*.

Now the operation of the present embodiment will be described.

Recording on the recording sheet 15 is made by the recording head 2 that discharges ink, while the reciprocation of the head cartridge 1 and the pitch conveyance of the recording sheet 15 are repeated as described earlier. During the recording operation, the head cartridge 1 reciprocates to scan within a range where the reservoir tank 3 is not allowed to engage with the refilling tank 5. Therefore, no ink refilling is executed from the refilling tank 5 into the reservoir tank 3. Also, at this juncture, the valve members 17*a* and 17*b* of the reservoir tank 3 are closed. As a result, the reservoir tank 3 functions almost the same as the ink tank 1101 described in conjunction with FIG. 15, thus effectuating the stabilized ink supply to the recording head 2. For the present embodiment, the air induction groove 19 is provided, making it possible to keep the liquid level of the negative pressure generating member housing chamber at the height designated by a reference mark L in FIG. 2A for the steady consumption of ink in the ink reserving chamber 14.

When the amount of ink in the reservoir tank 3 becomes smaller along with recording on the recording sheet 15, the head cartridge 1 is driven to shift to a position beyond the recording area, and as shown in FIG. 2B, the tubes 18*a* and 18*b* are inserted into the ink reserving chamber 14 through the valve members 17*a* and 17*b*, respectively, thus coupling the reservoir tank 3 and the refilling tank 5 together. Then, the air in the ink reserving chamber 14 and the air in the refilling tank 5 become conductive through the upper tube 19. At the same time, ink in the ink reserving chamber 14 and ink in the refilling tank 5 become conductive through the lower tube 20. Hence, by the conduction of air, the air pressure in the ink reserving chamber 14 and the air pressure in the refilling tank 5 are balanced, while by the conduction of ink, ink is refilled into the ink reserving chamber 14 by means of the head pressure difference between the ink reserving chamber 14 and the refilling tank 5 until the water heads of both of them are made equal, that is, refilling is executed until the liquid surfaces become equal both of them.

When ink refilling is completed, the reservoir tank 3 parts from the refilling tank 5 by the movement of the carriage 4. Then, recording operation is resumed. At this juncture, each of the valve members 17*a* and 17*b*, and each of the tubes 18*a* and 18*b* are closed. There is no ink leakage from any one of them.

In this respect, the determination of ink amount in the ink reserving chamber 14 may be made in accordance with the result of detection to be executed by the provision of optical or electrical means for the ink reserving chamber 14 thereby to detect liquid remains in it or in accordance with the estimated ink consumption based upon the period of recording operation measured by a timer provided for the recording apparatus. Also, it may be possible to determine whether or not the ink refilling is completed from the refilling tank 5 into the ink reserving chamber is completed in accordance with the period of time during which the reservoir tank 3 and the refilling tank are in engagement, not necessarily detecting the actual height of the liquid surface. Here, it is arranged to make the period of time very short for both of them to be in such state of engagement.

As described above, when ink is refilled from the refilling tank 5 into the reservoir tank 3, it is arranged for the present embodiment that the reservoir tank 3 and the refilling tank 5 form a space essentially closed from the outside. Therefore, as far as the liquid surface of the ink reserving chamber 14 is lower than the liquid surface of the refilling tank 5, there is no possibility that ink overflows from the recording head 2 irrespective of the condition of ink remains in both of them, that is, even if there is a slight difference in pressure between them, ink does not overflow from the recording head. Therefore, it is unnecessary to close the nozzle unit of the recording head 2 or the air communication port 16*a*, thus making ink refilling possible without any significant restrictions imposed upon it.

In this respect, when ink in the refilling tank 5 becomes short, it is possible to replace the used tank with a new one or ink may be refilled into the refilling tank 5. Nevertheless, it is preferable to arrange the capacity of a refilling tank 5 larger than that of the reservoir tank 3 in order to minimize the frequencies of exchanging refilling tanks 5 or refilling ink into the refilling tank.

Figure 3:
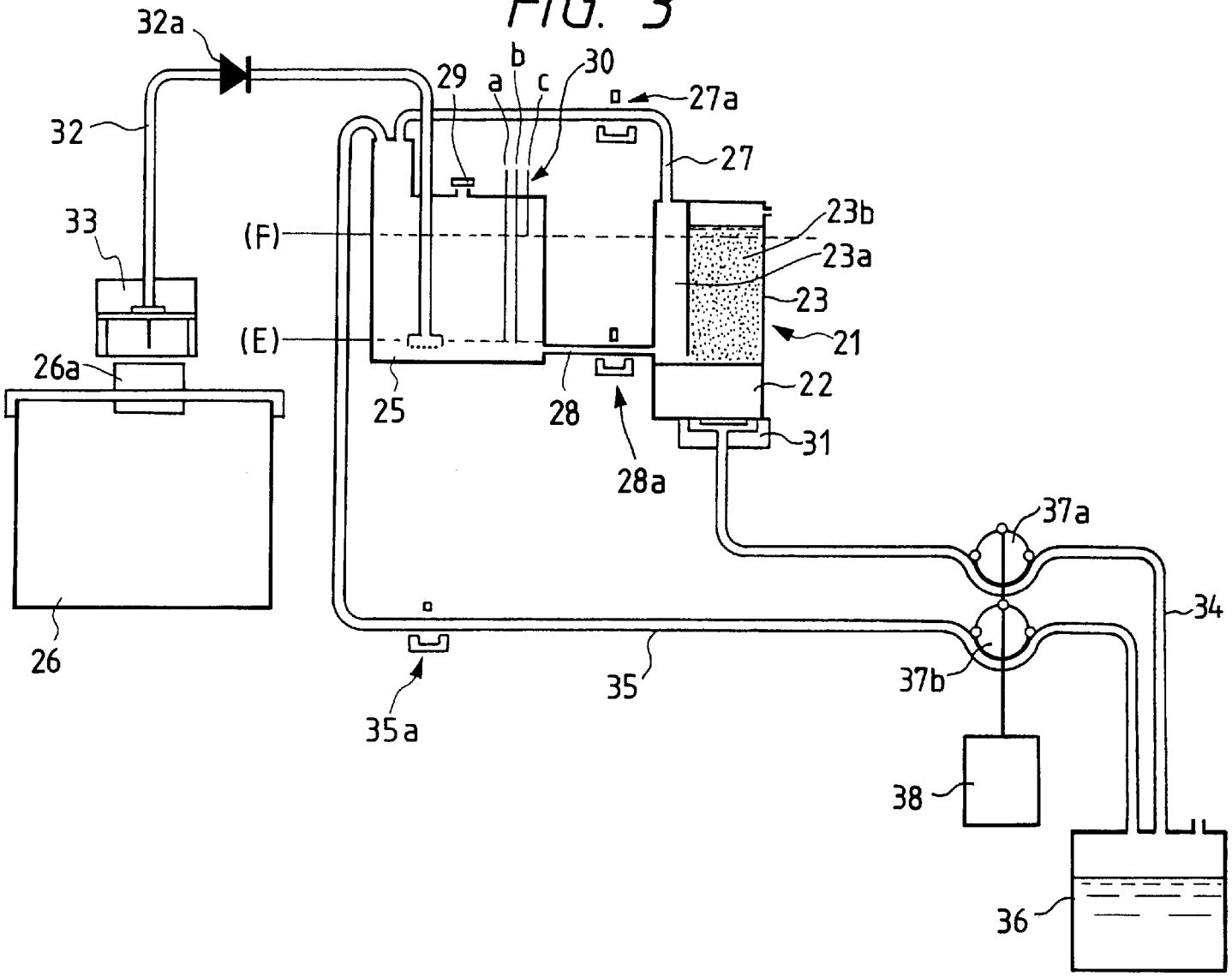
FIG. 3 is a view which shows the ink paths for a liquid jet recording apparatus, illustrating a second embodiment in accordance with the present invention.

(Second Embodiment) FIG. 3 is a view which shows the ink paths of a liquid jet recording apparatus, illustrating a second embodiment in accordance with the present invention. In this respect, the liquid surface of ink in the negative pressure generating member housing chamber will be omitted in the embodiment given below.

As shown in FIG. 3, the present embodiment further comprises a main tank 26 for supplying ink to a refilling tank 25 in addition to a head cartridge 21 formed integrally with a reservoir tank 23, a recording head 22, and the refilling tank 25 for keeping ink to be refilled into the reservoir tank 23. The main tank 26 is formed by a flexible material, which is compressed as ink in the main tank 26 is reduced.

The head cartridge 21 and the refilling tank 25 are mounted on a carriage (not shown) that reciprocates to scan in the horizontal direction. In this respect, it may be possible to arrange the carriages for mounting the head cartridge 21 and the refilling tank 25 separately or arrange a carriage that can be shared by them for use.

The reservoir tank 23 of the head cartridge 21 is substantially the same as the one described in the first embodiment with the exception of the structure to connect it with the refilling tank 25. This tank comprises an ink reserving chamber (second chamber) 23*a* and a negative pressure generating member housing chamber (first chamber) 23*b*, which are partitioned by a partition wall having a communicating unit at its bottom. In accordance with the present embodiment, the reservoir tank 23 and the refilling tank 25 are connected by means of a communication tube 27 that conductively connects the air in the ink reserving chamber 23*a* with the air in the refilling tank 25, as well as by means of an ink tube that conductively connect ink in the ink reserving chamber 23*a* with ink in the refilling tank 25. In this respect, the tubes 27 and 28 are provided with the closing valves 27*a* and 28*a* that close the paths between the refilling tank 25 and the ink reserving chamber 23*a*, respectively, by depressing to squeeze each of the tubes 27 and 28. For the refilling tank 25, there are provided an air releasing valve 29, which is open and closed by means of a driving source (not shown), and an ink remain detecting sensor 30, which comprises three electrode needles a, b, and c to detect ink remains in the refilling tank 25.

Also, within the scanning area of the head cartridge 21, but outside the recording area on a recording sheet, a cap 31 is arranged to cap the recording head 22 in order to maintain the ink discharge characteristics of the recording head 22 in good condition. The position in which the recording head 21 is capped by the cap 31 is defined as the home position thereof.

The refilling tank 25 is connected with the main tank 26 by means of a main tube 32. One end portion of the main tube 32 is inserted into the vicinity of the bottom of the refilling tank 25. A joint cap 33 having a hollow needle arranged for it is installed on the other end portion of the main tube 32. The needle of the joint cap 33 penetrates a rubber plug 26*a* of the main tank 26 to enable the main tank 26 to communicate with the refilling tank 25. In this respect, a one way valve 32*a* is provided for the main tube 32 in order to prevent any backward flow of ink from the refilling tank 25 to the main tank 26.

The cap 31 is connected with a waste ink tank 36 by means of a suction tube 34 having a suction pump 37*a* arranged for it. Further, the waste ink tank 36 and the refilling tank 25 are connected by a negative pressure tube 25 having a closing valve 35*a* and a negative pressure generating pump 37*b* arranged for it. The negative pressure tube 35 is connected with the refilling tank 25 at the upper end portion of the refilling tank 25. The suction pump 37*a* and the negative pressure generating pump 37*b* are tube pumps, which are driven by a pump motor 38, respectively.

Now, the operation of the present embodiment will be described.

During recording operation, the closing valve 35*a* and the air releasing valve 29 are closed. Thus, the reservoir tank 23 and the refilling tank 25 form one large ink reserving chamber by use of the ink reserving chamber 23*a* of the reservoir tank 23 and the refilling tank 25. Therefore, these tanks function the same as the ink tank 1101 described in conjunction with FIG. 15, thus effectuating a stabilized supply of ink to the recording head 22.

Here, in accordance with the present embodiment, the leading end of the main tube 32 is always immersed in ink in the refilling tank 25, and it is arranged not to supply ink from the main tank 26 as it is even when the liquid surface in the interior of the refilling tank 25 is lowered along the ink consumption.

When the ink amount in the reservoir tank 23 and the refilling tank 25 are made smaller by recording operation, it is arranged to begin refilling ink into the reservoir tank 23. The ink amount in the reservoir tank 23 is determined in the same manner as the first embodiment.

For the ink refilling operation, the closing valves 27*a* and 28*a* are closed, at first, and then, ink is refilled into the refilling tank 25 by the method to be described later. After that, the air releasing valve of the refilling tank 25 is once open while the closing valves 27*a* and 28*a* are still closed, thus making the inner pressure of the refilling tank 25 equal to the atmospheric pressure. The air releasing valve 29 is immediately closed after it has been once open. Then, the closing valves 27*a* and 28*a* of the communication tube 27 and ink tube 28 are open. In this way, as in the first embodiment, ink in the refilling tank 25 is refilled into the ink reserving chamber 23*a* until the liquid surfaces of the refilling tank 25 and ink reserving chamber 23*a* become equalized. When the ink refilling is completed, recording is resumed.

As described above, the closing valve 35*a* and the air releasing valve 29 of the negative pressure tube 35 are closed when ink is refilled from the refilling tank 25 into the reservoir tank 23 in accordance with the present embodiment, and, further, the main tube 32 is provided with the one way valve 32*a*. Hence, it is arrange to enable the reservoir tank 23 and the refilling tank 25 to form an essentially closed space from the outside. Therefore, as in the first embodiment, it is possible to refill ink quickly without any leakage from the recording head 22 without capping the recording head 22 or closing the air communication port of the negative pressure generating member housing chamber 23*b* as far as the liquid surface of the ink reserving chamber 23*a* is kept lower than the liquid surface of the refilling tank 25. Further, in accordance with the present embodiment, the refilling tank 25 and the reservoir tank 23 are connected by means of the communication tube 27 and the ink tube 28. Therefore, with a simpler structure, it is possible to prevent ink leakage from the connecting parts between them.

Here, the description has been made of the case where the closing valves 27*a* and 28*a* are open during recording operation, but it may be possible to refill ink from the refilling tank 25 into the reservoir tank 23 by opening the closing valves 27*a* and 28*a* when the liquid amount in the ink reserving chamber 23*a* becomes smaller as in the first embodiment, while the closing valves 27*a* and 28*a* are closed during recording operation. In this case, the conduction between the ink reserving chamber 23*a* and the refilling tank 25 is cut off. Therefore, it is not necessarily required to keep the leading end of the main tube to be immersed in ink in the refilling tank 25 for effectuating the stabilized ink supply to the outside during recording operation.

Now, for the present embodiment, ink in the refilling tank 25 is being reduced, and when the amount of ink in the refilling tank 25 becomes smaller, it is possible to refill ink from the main tank 26 into the refilling tank 25.

Refilling ink from the main tank 26 into the refilling tank 25 is executed when the height of the liquid surface of ink in the refilling tank 25 becomes lower than a position designated-by a reference mark E. The detection of this height of the liquid surface is performed by means of the ink remain detecting sensor 30. Here, the leading end of the main tube 32 is positioned still lower than the position where the height of the liquid level of ink is at E.

When the refilling operation of ink into the refilling tank 25 begins, the head cartridge is driven to return to the home position, at first, where the recording head 22 is capped by the cap 31. Then, the closing valves 27*a* and 28*a* are closed to make the refilling tank 25 a closed space. In this state, the closing valve 35*a* is open, and the negative pressure generating pump 27*b* is driven. The interior of the refilling tank 25 is made a close space having a reduced pressure, thus sucking ink in the main tank 26 into the refilling tank 25.

When ink is refilled into the refilling tank 25 and the ink remain detecting sensor 30 detects that the liquid surface has reached the position at F, the closing valve 35*a* of the negative pressure generating tube 35 is closed to suspend the negative pressure generating pump 37*a*, thus terminating the refilling operation of ink into the refilling tank 25. Here, in this state, the inner pressure of the refilling tank 25 is in an extreme negative condition. Therefore, if this state is left as it is, there is a fear that ink flows backward when ink is refilled into the reservoir tank 23 with the closing valves 27*a* and 28*a* of the communication tube 27 are open. The reason that the air releasing valve of the refilling tank 25 is once open when executing the refilling operation of ink into the reservoir tank 23 as described earlier is to prevent ink from flowing backward due to the negative pressure thus exerted in the refilling tank 25.

Further, in accordance with the present embodiment, the main tank 26 is detachably installed. As a result, if ink in the main tank 26 becomes short, it is possible to replace the main tank 26 with a new tank.

(Third Embodiment)

Figure 4:
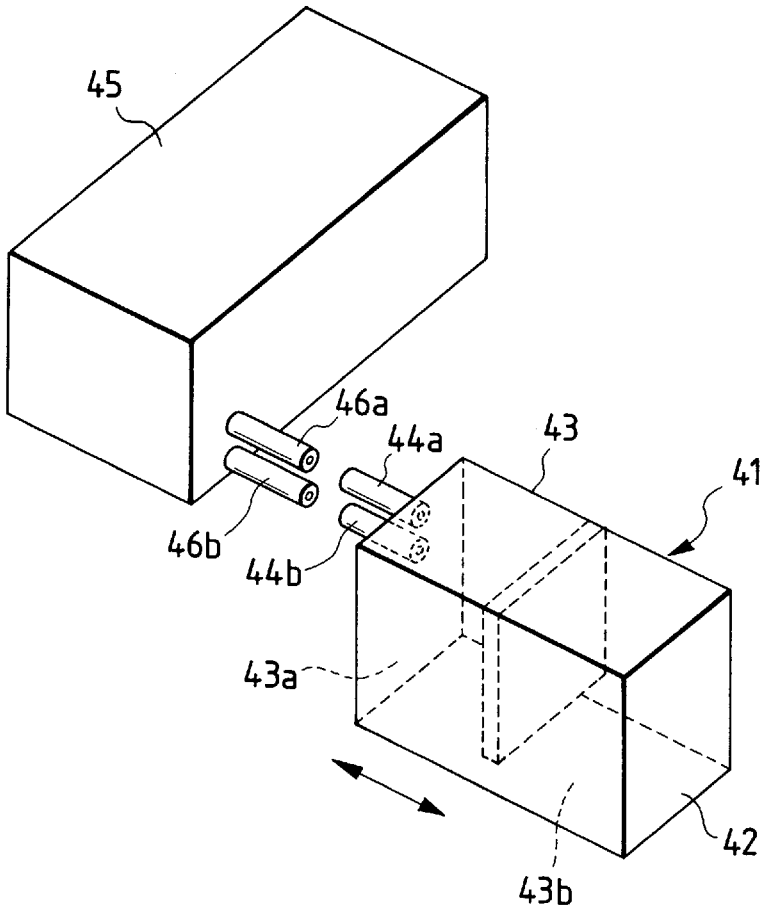
FIG. 4 is a perspective view which schematically shows a refilling tank and a head cartridge, illustrating a third embodiment in accordance with the present invention.
Figure 5:
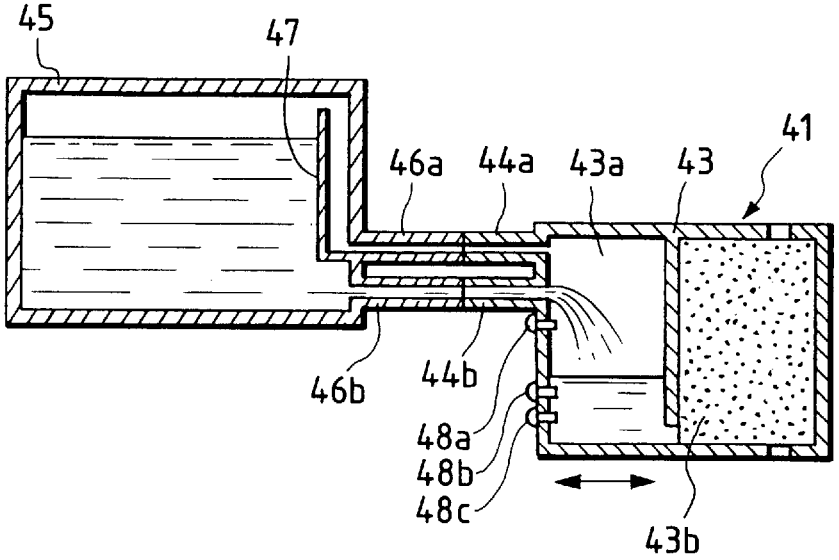
FIG. 5 is a cross-sectional view taken along the tubes of the refilling tank and the head cartridge represented in FIG. 4, which shows the state of engagement between them.

FIG. 4 is a perspective view schematically showing a refilling tank and a head cartridge, illustrating a third embodiment in accordance with the present invention. FIG. 5 is a cross-sectional view taken along the tubes of the refilling tank and the head cartridge represented in FIG. 4, showing the state of engagement between them.

The present embodiment is fundamentally the same as the first embodiment in which ink is refilled from the refilling tank 45 into the reservoir tank 43 by arranging to enable the reservoir tank 43 of the head cartridge 41, which is movably installed in the horizontal direction, to engage with the refilling tank 45 having a capacity larger than-that of the reservoir tank 43.

As shown in FIG. 4 and FIG. 5, the reservoir tank 43 comprises an ink reserving chamber 43*a* and a negative pressure generating member housing chamber 43*b*. The ink reserving chamber 43*a* is arranged to face the refilling tank 45 side. Here, the negative pressure generating member is omitted in the representation of FIG. 4. The refilling tank 45 is arranged above the reservoir tank 43, while its position in the vertical direction is partly overlapped with the reservoir tank 43. On each of the opposing faces of the refilling tank 45 and the reservoir tank 43, air communication tubes 44*a* and 46*a*, and liquid communication tubes 44*b* and 46*b*, which extend in the directions opposing to each other, are arranged to connect both of them. The air and liquid communication tubes 44*a* and 44*b* are arranged in the upper part of the reservoir tank 43. The liquid and air communication tubes 46*a* and 46*b* are arranged in the lower part of the refilling tank 45. Also, the air communication tubes 44*a* and 46*a* are arranged above the liquid communication tubes 44*b* and 46*b*.

As shown in FIG. 5, the end portion of the air communication tube 46 of the refilling tank 45 is guided by means of an inner tube 47 in the refilling tank 45 to the upper part of the refilling tank 45 so that no ink in the refilling tank 45 enters the air communication tube 46. Also, in the ink reserving chamber 43*a* of the reservoir tank 43, three electrodes 48*a*, 48*b* and 48*c* are provided to function as an ink remain detecting sensor. By means of the status of electrical conduction resulting from the presence of ink, it is made possible to detect ink remains in the ink reserving chamber 43*a*.

Figure 6A:
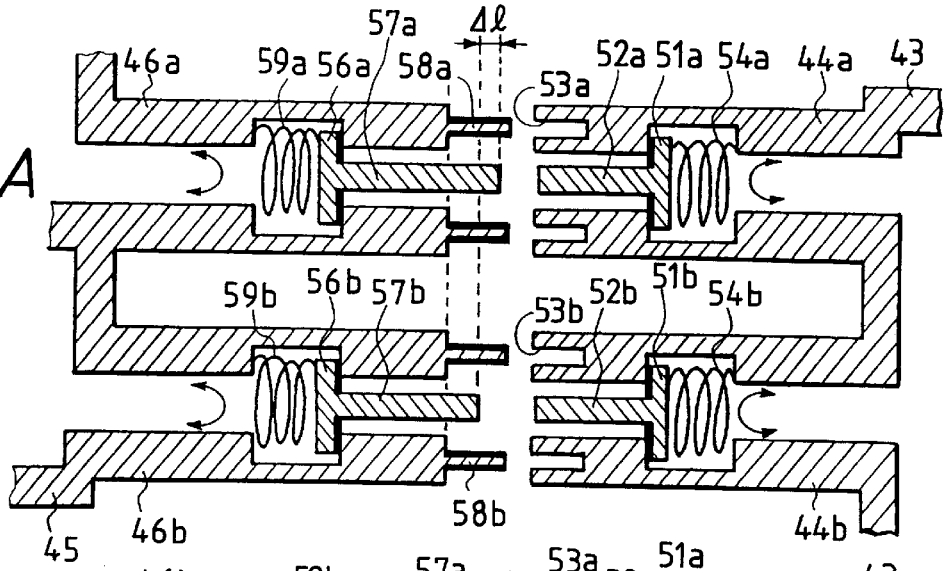
FIGS. 6A, 6B, and 6C are views showing the sections of the gaseous communicating tube and the liquid communicating tube represented in FIG. 4, together with the operation of each valve mechanism thereof.
Figure 6B:
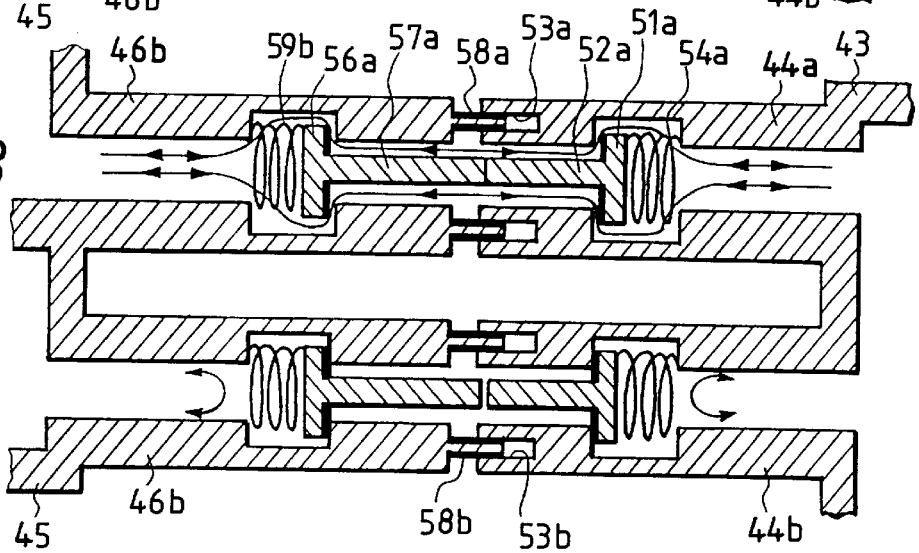
Figure 6C:
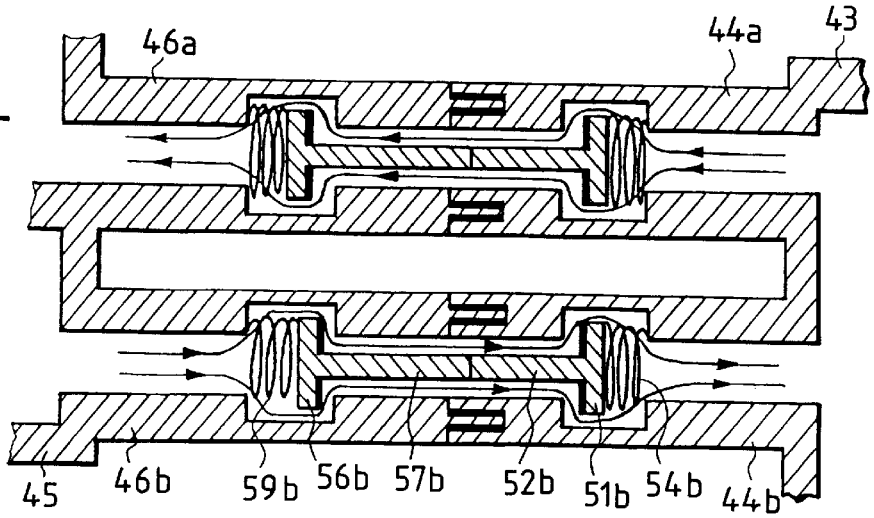

At each end portion of the air communication tubes 44*a* and 46*a* and the liquid communication tubes 44*b* and 46*b*, a valve mechanism is provided, respectively. These tubes are closed except when the air communication tubes 44*a* and 46*a* themselves and the liquid communication tubes 44*b* and 46*b* themselves are connected. Here, with reference to FIGS. 6A, 6B and 6C, the description will be made of this valve mechanism. FIGS. 6A, 6B and 6C are views showing the sections of the air communication tubes and the liquid communication tubes represented in FIG. 4, together with the operations of each valve mechanism.

As shown in FIG. 6A, the inner diameters of the air communication tube 44*a* and liquid communication tube 44*b* of the reservoir tank 43 are made larger at its intermediate sections, respectively. In these sections valve bodies 51*a* and 51*b* are arranged. The valve bodies are always biased by means of compression springs 54*a* and 54*b* toward the leading ends of the tubes. Hence, the interior of the air communication tube 44*a* and liquid communication tube 44*b* are closed from the outside. For the valve bodies 51*a* and 51*b*, shafts 52*a* and 52*b* are provided, which are thinner than the inner diameter of each tube, and are arranged to extend toward each leading end of the tubes. When these shafts are depressed into the inner side, the valve bodies 51*a* and 51*b* are open. On the surfaces of the leading ends of the air communication tube 44*a* and liquid communication tube 44*b*, grooves 53*a* and 53*b* are formed on its entire circumferences, respectively.

Meanwhile, for the air communication tube 46*a* and liquid communication tube 46*b* of the refilling tank 45, there are likewise provided the valve bodies 56*a* and 56*b* formed integrally with the shafts 57*a* and 57*b*, and the compression springs 59*a* and 59*b* that cause the tubes to be biased toward its leading ends. Hence, the interior of the air communication tube 46*a* and liquid communication tube 46*b* are closed from the outside. However, the length of the shaft 57*a* arranged for the valve body 56*a* of the air communication tube 46*a* is made longer by $\Delta 1$ than the length of the shaft 57*b* arranged for the valve body 56*b* of the liquid communication tube 46*b*. When the reservoir tank 43 engages with the refilling tank 45, the shafts 52*a* and 57*a* of the air communication tubes 44*a* and 46*a* themselves are in contact earlier than the shafts 52*b* and 57*b* themselves of the liquid-communication tubes 44*b* and 46*b*.

Also, on the surfaces of the leading ends of the air communication tube 46*a* and liquid communication tube 46*b* of the refilling tank 45, the extrusions 58*a* and 58*b*, which fit into the grooves 53*a* and 53*b*, are formed on its entire circumferences, respectively. Sealing members are fixed to the extrusions 58*a* and 58*b*. When the extrusions 58*a* and 58*b* fit into the grooves 53*a* and 53*b*, the air communication tubes 44*a* and 46*a* and liquid communication tubes 44*b* and 46*b* are airtightly connected.

Now, the operation of the present embodiment will be described.

During recording operation by means of the recording head 42, the valve mechanisms of the air communication tube 44*a* and liquid communication tube 44*b* are closed. The reservoir tank 43 functions as the ink tank 1101 described in conjunction with FIG. 15, thus effectuating a stabilized ink supply to the recording head 42.

When it is detected along with the recording performed by the recording head 42 that the ink amount in the ink reserving chamber 43*a* of the reservoir tank 43 is lower than the position of the electrode 48*b*, which is second from the bottom, the head cartridge 41 is driven to shift toward the refilling tank 45. Then, both of them engage with each other.

Here, the detailed description will be made of the operation at this stage in conjunction with FIGS. 6B and 6C. At first, as shown in FIG. 6B, the extrusions 58*a* and 58*b* fit into the grooves 53*a* and 53*b* to enable the air communication tubes 44*a* and 46*a* themselves and liquid communication tubes 44*b* and 46*b* themselves are connected airtightly. Then, when the reservoir tank 43 further approaches, the shaft 57*a* of the valve body 56*a* of the air communication tube 46 of the refilling tank 45 abuts upon the shaft 52*a* of the valve body 51*a* of the air communication tube 44*a* of the reservoir tank 43. Thus, the valve bodies 51*a* and 56*a* are caused to shift by means of its own compression forces against the spring forces of the compressed coil springs 54*a* and 59*a*. In this way, the air communication tubes 44*a* and 46*a* themselves are conductively connected. At this juncture, air flows from the location having a higher pressure to the location having a lower pressure. As a result, the inner pressure of the reservoir tank 43 and the inner pressure of the refilling tank 45 is balanced.

When the reservoir tank 43 further approaches as shown in FIG. 6C, the shaft 57*b* of the valve body 56*b* of the liquid communication tube 46*b* of the refilling tank 45 abuts upon the shaft 52*b* of the valve body 51*b* of the liquid communication tube 44*b* of the reservoir tank 43. The valve bodies 51*b* and 56*b* are caused to shift by means of its own compression forces against the spring forces of the compressed coil springs 54*b* and 59*b*. In this way, the liquid communication tubes 44*b* and 46*b* themselves are conductively connected.

When the liquid communication tubes 44*b* and 46*b* themselves are conductively connected, ink in the refilling tank 45 is refilled into the ink reserving chamber 43*a* of the reservoir tank 43 through the liquid communication tubes 44*b* and 46*b*, because the refilling tank 45 is positioned higher than the reservoir tank 43. Along with the refilling of ink into the ink reserving chamber 43*a*, the air in the ink reserving chamber 43*a* shifts to the interior of the refilling tank 45.

Ink is refilled into the ink reserving chamber 43*a*, and when it is detected that the liquid surface thereof reaches the uppermost electrode 48*a*, the head cartridge 41 is caused to shift in the direction in which it parts from the refilling tank 45. Thus, the engagement between the reservoir tank 43 and the refilling tank 45 is released by the operation opposite to the connecting operation, and the refilling of ink into the reservoir tank 43 disengages. With the disengagement between the reservoir tank 43 and the refilling tank 45, the air communication tubes 44*a* and 44*b* and liquid communication tubes 46*a* and 46*b* are closed. As described above, the ink refilling is suspended in accordance with the result of detection by the ink remain detecting sensor. Therefore, once ink has been refilled, the ink amount in the ink reserving chamber 43*a* is substantially constant irrespective of the ink amount in the refilling tank 45.

In accordance with the present embodiment, refilling of ink into the ink reserving chamber 43*a* of the reservoir tank 43 is executed until its liquid surface has reached a given height after refilling. Also, in accordance with the present embodiment, the air communication tubes 44*a* and 46*a* are conductively connected earlier, thus making it possible to balance the air pressures in the refilling tank 45 and ink reserving chamber 43*a* for the implementation of a stabilized ink refilling.

Figure 7:
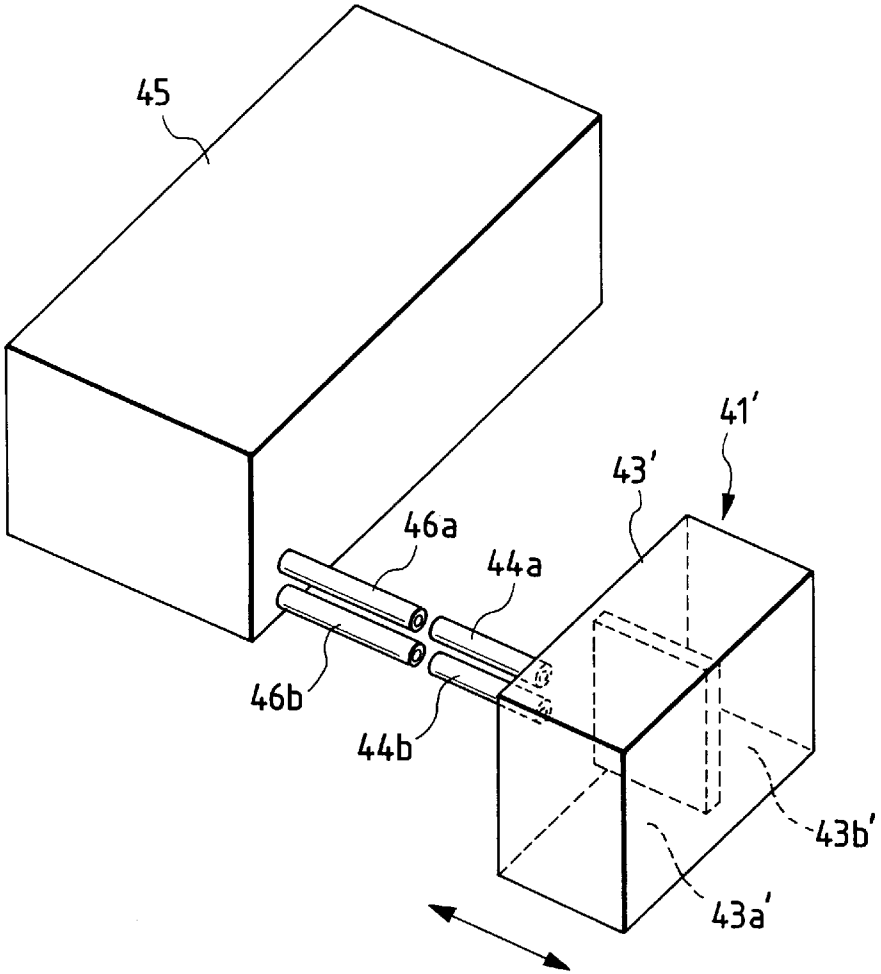
FIG. 7 is a perspective view which shows a variation of the third embodiment in accordance with the present invention.

FIG. 4 and FIG. 5 represent one example of the reservoir tank 43 in which the ink reserving chamber 43*a* and the negative pressure generating member housing chamber 43*b* are arranged in the shifting direction of the head cartridge 41. However, as shown in FIG. 7, it may be possible to arrange and position the ink reserving chamber 43*a*' and the negative pressure generating member housing chamber 43*b*' of the reservoir tank 43' in a direction perpendicular to the shifting direction of the head cartridge 41'. In this case, too, the air communication tube 44*a* and liquid communication tube 44*b* are arranged in a position opposite to the air communication tube 46*a* and liquid communication tube 46*b* of the refilling tank 45. With the arrangement of the head cartridge 41' as shown in FIG. 7, it is possible to effectively use the space in the apparatus. Here, in FIG. 7, too, the negative pressure generating member is omitted in the representation thereof.

The first to third embodiments described above deal with the example of a liquid jet recording apparatus provided with a ink supply system using pit-in or tubes. Each of the embodiments is described in accordance with the example in which a head cartridge is mounted on a carriage capable of scanning. For example, however, when the present invention is applied to a recording apparatus that utilizes a full-line head, it should be good enough if only the head cartridge is positioned within the recording apparatus, not necessarily limited to positioning it on the carriage.

Further, the present invention is preferably usable as a refilling kit for a liquid jet head cartridge to be used for the conventional liquid jet recording apparatus. Now, therefore, the description will be made of refilling kits using the liquid refilling method of the present invention in accordance with fourth to sixth embodiments thereof given below.

(Forth Embodiment)

Figure 8:
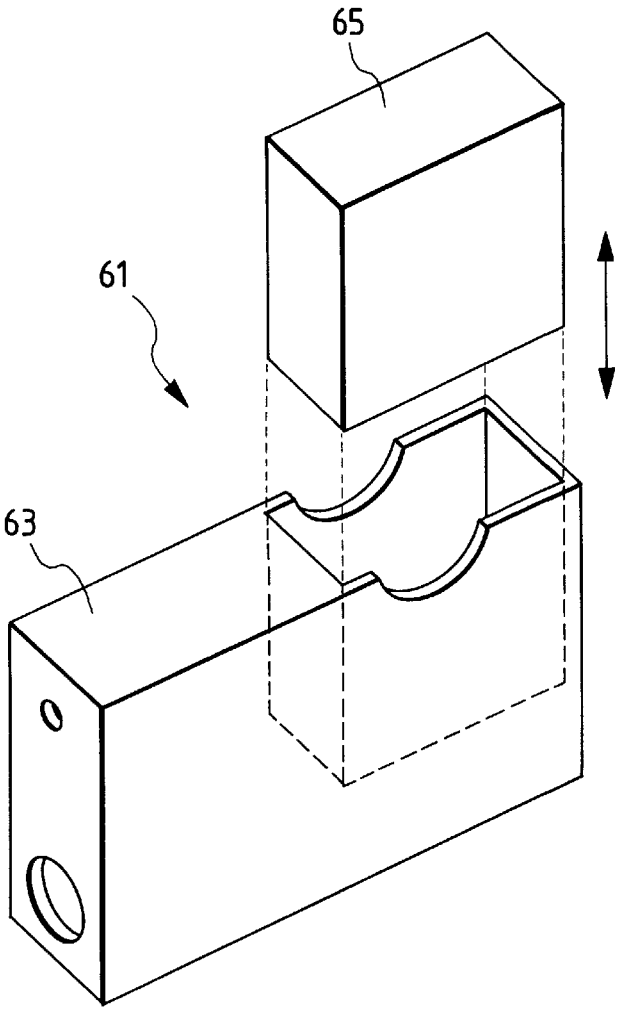
FIG. 8 is a perspective view which shows an integrated ink tank, illustrating a fourth embodiment in accordance with the present invention.
Figure 9:
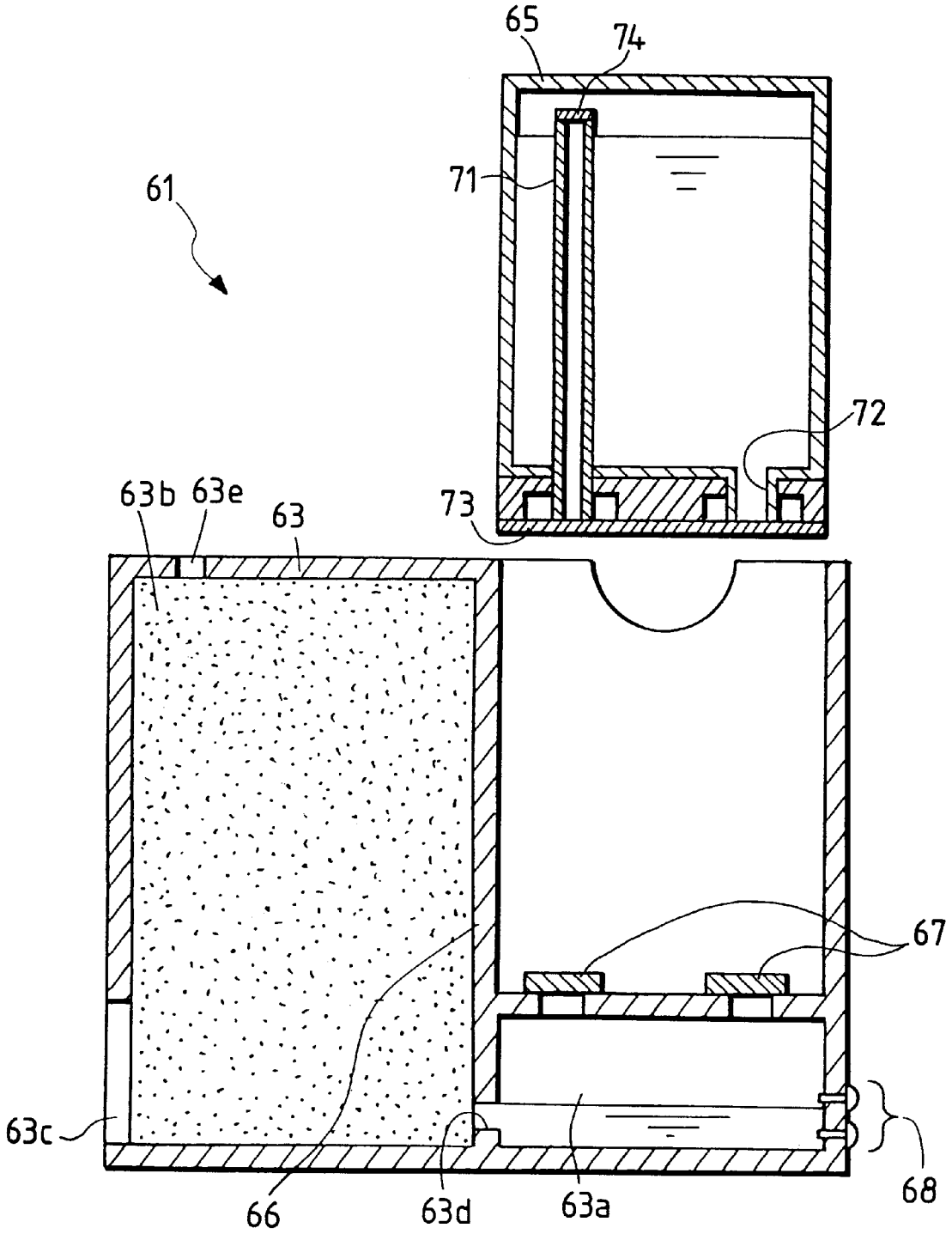
FIG. 9 is a cross-sectional view which shows the integrated ink tank represented in FIG. 8.

FIG. 8 is a perspective view which shows an integrated ink tank (a refilling kit), illustrating a fourth embodiment in accordance with the present invention. FIG. 9 is a cross-sectional view which shows the integrated ink tank represented in FIG. 8.

In accordance with the present embodiment, the integrated ink tank 61 comprises an ink tank 63 and a refilling tank 65 detachably mountable on the ink tank 63. The ink tank 63 corresponds to the reservoir tank of the first to third embodiments in accordance with the present invention.

Now, with reference to FIG. 9, the description will be made of the structures of the ink tank 63 and the refilling tank 65.

The interior of the ink tank 63 is divided by a partition wall, which is provided a communicating unit 63*d* on its lower end, into a negative pressure member housing chamber 63*d* that holds a negative pressure generating member in it, and an ink reserving chamber 63*a* that keeps ink as it is. On the wall surface that forms the negative pressure generating member housing chamber 63*d*, there are formed an air communication port 63*e* and a supply port 63c for supplying ink to a recording head (not shown). The ink reserving chamber 63*a* is arranged to make its height lower than the negative pressure member housing chamber 63*b* in order to install the refilling tank 65 on its upper part. Also, on the side wall of the ink reserving chamber 63*a*, an ink remain detecting sensor 68, which is formed by two electrodes, is provided. On the upper wall, two valve members 67 are arranged for the connection with the refilling tank 65. These valve members 67 are usually closed, but are open when the air communication tube 71 and liquid communication tube 72 of the refilling tank 65 are inserted.

On the lower end of the refilling tank 65, the air communication tube 71 and liquid communication tube 72 extruded, which are inserted into the two valve members of the ink tank 63, respectively. The upper end of the air communication tube 71 extends to the vicinity of the upper end of the refilling tank 65, and is in contact with the inner air through a water repellent film 74 that allows gas to pass but not liquid. The upper end of the liquid communication tube 72 is open to the inner bottom wall of the refilling tank 65 to be in contact with ink in its interior. Also, the lower end surfaces of the air communication tube 71 and liquid communication tube 72 are sealed by means of films 73 so that no ink leaks before the refilling tank is installed. Further, with the provision of the water repellent film 74, there is no possibility that ink enters the air communication tube 72 during the transportation of tanks for delivery or the like.

When the refilling tank 65 is installed on the ink tank 63 in accordance with the structure described above, the films 73 are broken by the air communication tube 71 and liquid communication tube 72 that abut upon the films, and when the refilling tank 65 is further pushed in, the air communication tube 71 and liquid communication tube 72 are inserted into the valve members 67. In this way, ink in the refilling tank 65 is refilled into the ink reserving chamber 63*a* through the liquid communication tube 72. In the meantime, the air in the ink reserving chamber 63*a* moves to the interior of the refilling tank 65 through the liquid communication tube 71. In the state where the refilling tank 65 is completely installed on the ink tank 63 (in the integrated ink tank 61), the ink reserving chamber 63*a* and refilling tank 65 essentially forms a closed space. Therefore, ink is not caused to overflow from the air communication port 63*e* and supply port 63*c*, thus making it possible to refill ink into the ink tank 63 quickly.

Along with the consumption of ink in the negative pressure generating member housing chamber 63*b*, the air is inducted into the negative pressure generating member housing chamber 63*b* through the air communication port 63*e*, and then, the air enters the ink reserving chamber 63*a* through the connecting unit 63*d*. The air thus residing in the ink reserving chamber 63*a* shifts to the refilling tank 65 through the air communication tube 71. Therefore, ink in the refilling tank 65 is refilled into the ink reserving chamber 63*a* to that extent. On the other hand, ink in the ink reserving chamber 63*a* is refilled into the negative pressure generating member in the negative pressure generating member housing chamber 63*b* through the communicating unit 63*d*. By means of this air-liquid conversion between the negative pressure generating member housing chamber 63*b* and the ink reserving chamber 63*a*, it is made possible for the negative pressure generating member to hold a specific amount of ink.

Then, ink in the refilling tank 65 is refilled into the ink reserving chamber 63*a* completely, and further, if it is detected by the ink remain detecting sensor 68 that ink remains in the ink reserving chamber 63*a* become short, the refilling tank 65 currently installed is removed to be replaced with a new refilling tank 65. In this way, the refilling tank 65 can be utilized as a refilling kit with respect to the ink tank 63. The tank formed integrally by the refilling tank 65 and the ink tank 63 is defined as an integrated ink tank 61.

Now, by means of the air-liquid conversion described above, the air is accumulated in the ink reserving chamber 63*a*. Unless the air thus accumulated in the ink reserving chamber 63*a* escapes to the refilling tank 65, it stands in the way of refilling ink from the refilling tank 65 into the ink reserving chamber 63*a*. Here, therefore, it is preferable to position the air communication tube 71 of the refilling tank 65 in a location where the air is induced from the negative pressure generating member housing chamber 63*b*, that is, the location as near as possible to the boundary with the negative pressure generating member housing chamber 63*b*, so as to make it possible to allow the accumulated air in the ink reserving chamber 63*a* to escape to the refilling tank 65 efficiently. By positioning the air communication tube 71 in this manner, the refilling tank 65 and the ink reserving chamber 63*a* are made functional as one large ink reserving chamber by both of them together.

The present embodiment has been described so far by use of an integrated ink tank 61. Here, if a recording head is installed on the supply port 63*c* of the ink tank 63, the embodiment is arranged to be functional as a head cartridge. It may be possible to use a detachable recording head that forms one body together with the ink tank when the head is used or a recording head that is always made integral. Here, the mode made available by means of a refilling tank 65, an ink tank 63, and a recording head arranged in such a manner as described above is termed as an integrated head cartridge.

Figure 10A:
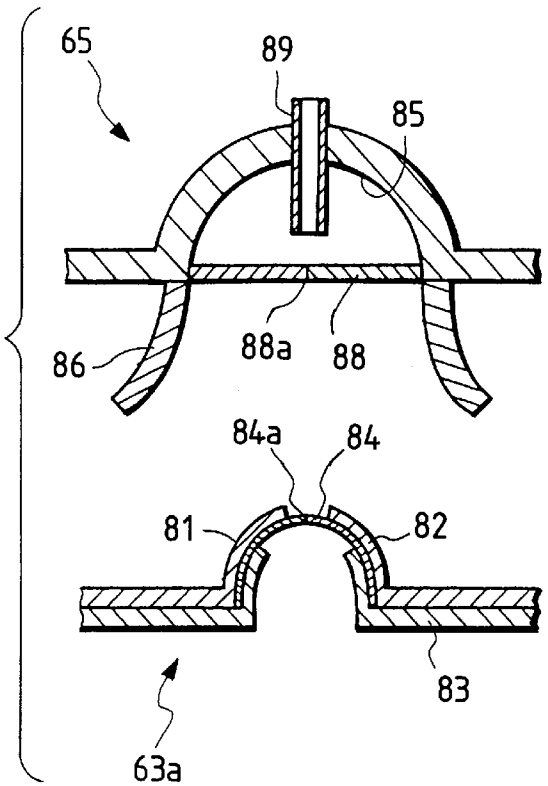
FIGS. 10A, 10B and 10C are enlarged sectional views showing one example of the structure whereby to connect an ink reserving chamber with a refilling tank for an integrated ink tank, together with the operation thereof.
Figure 10B:
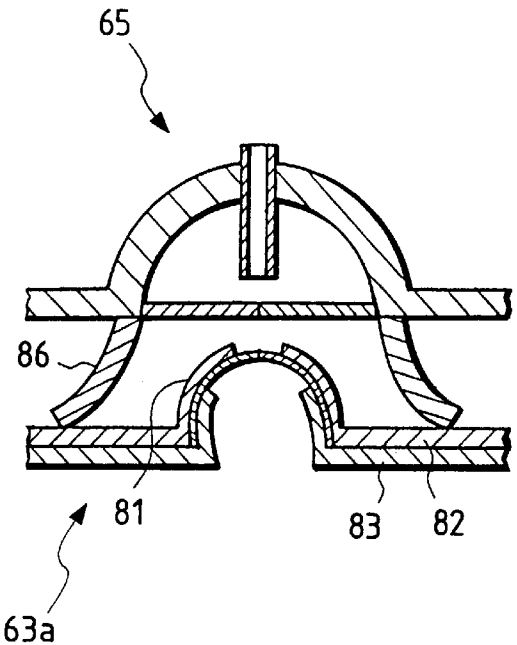
Figure 10C:
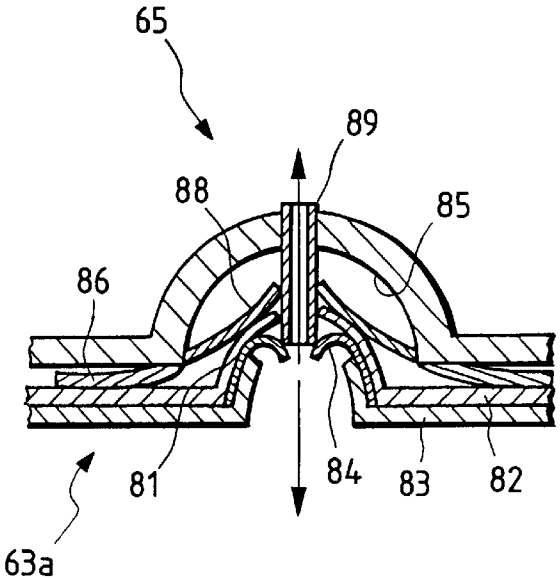

Now, in conjunction with FIGS. 10A, 10B and 10C, the description will be made of one example of the structure that connects the ink reserving chamber 63*a* of an ink tank 63 with a refilling tank 65. FIGS. 10A, 10B and 10C are enlarged sectional views showing one structural example of the connection between the ink reserving chamber and refilling tank for the ink tank of the present embodiment, together with the operation thereof.

As shown in FIG. 10A, on the upper wall of the ink reserving chamber 63*a*, a semi-spherical convex portion 81 is arranged. The convex portion is formed by a rubber film 84 having a cut off 84*a* on its central part, which is sandwiched by an outer member 82 and an inner member 73, each of them being provided with an aperture, respectively. The size of the aperture of the outer member 82 is such as to enable a needle 89, which will be described later, to pass it. The size of the aperture of the inner member 83 is made larger than that of the aperture of the outer member 82.

Meanwhile, on the lower wall of the refilling tank 65, a semi-spherical concave portion 85 is arranged for the convex portion 81 to be inserted into it at a position corresponding to the convex portion 81 of the ink reserving chamber 63*a*. For the concave portion 85, a hollow needle 89 is provided protrusively. Also, the inner space of the concave portion 85 is covered with a rubber film 88 having a cut-off in the central part thereof. Further, a skirt portion 86 formed by an elastic material such as rubber is provided on the circumference of the portion of the lower wall of the refilling tank 65 where the concave portion 85 is arranged.

With the connecting structure arranged as described above, the refilling tank 65 and ink reserving chamber 63*a* are closed, respectively, by means of the rubber films 88, 84 as shown in FIG. 10A when the refilling tank 65 and ink reserving chamber 63 are disconnected. Then, when the refilling tank 65 is installed in the ink reserving chamber 63*a*, the skirt portion 86 abuts upon the outer member 82 of the ink reserving chamber 63*a* at first as shown in FIG. 10B, thus closing the circumference of the convex portion 81.

When the refilling tank 65 is further pressed in, the skirt portion 86 is elastically deformed externally as shown in FIG. 10C, and the convex portion 81 is inserted into the concave portion 85. At this juncture, the outer member 82 of the convex portion 81 presses the rubber film 88 of the refilling tank 65 into the interior of the concave portion 85, thus enabling the cut-off 88*a* of the rubber film 88 to be open. The needle 89 protrudes from the rubber film 88. At the same time, the needle 89 enters the convex portion 81 through the aperture of the outer member 82 of the convex portion 81, thus pressing the rubber film 84 of the convex portion 81 into the interior of the convex portion 81. In this way, the cut-off 84*a* of the rubber film 84 is open, and the refilling tank 65 and the ink reserving chamber 63*a* are conductively connected through the needle 89.

When the refilling tank 65 is removed from the ink reserving chamber 63*a*, the convex portion 81 and the concave portion 85 are closed by the restoring forces of the rubber films 84 and 85, respectively.

This structure is applicable to both the arrangement for enabling liquids to be communicated themselves and the arrangement for enabling gases to be communicated themselves. Further, this structure is applicable to the embodiments described above or to each of the embodiments to be described hereunder. In this respect, if the timing to enable liquids to be communicated themselves should shift from the timing to enable gases to be communicated themselves as in the third embodiment, it is possible to cope with the situation by changing the height of the convex portion 81, the length of the needle 89, and others depending on the structure to be arranged for the communication of the liquids themselves and that for the communication of the gases themselves.

For the structure shown in FIGS. 10A, 10B and 10C, the convex portion 81 is arranged for the ink reserving chamber 63*a* and the concave portion 85 is arranged for the refilling tank 65, but these arrangements may be reversed.

(Fifth Embodiment)

Figure 11:
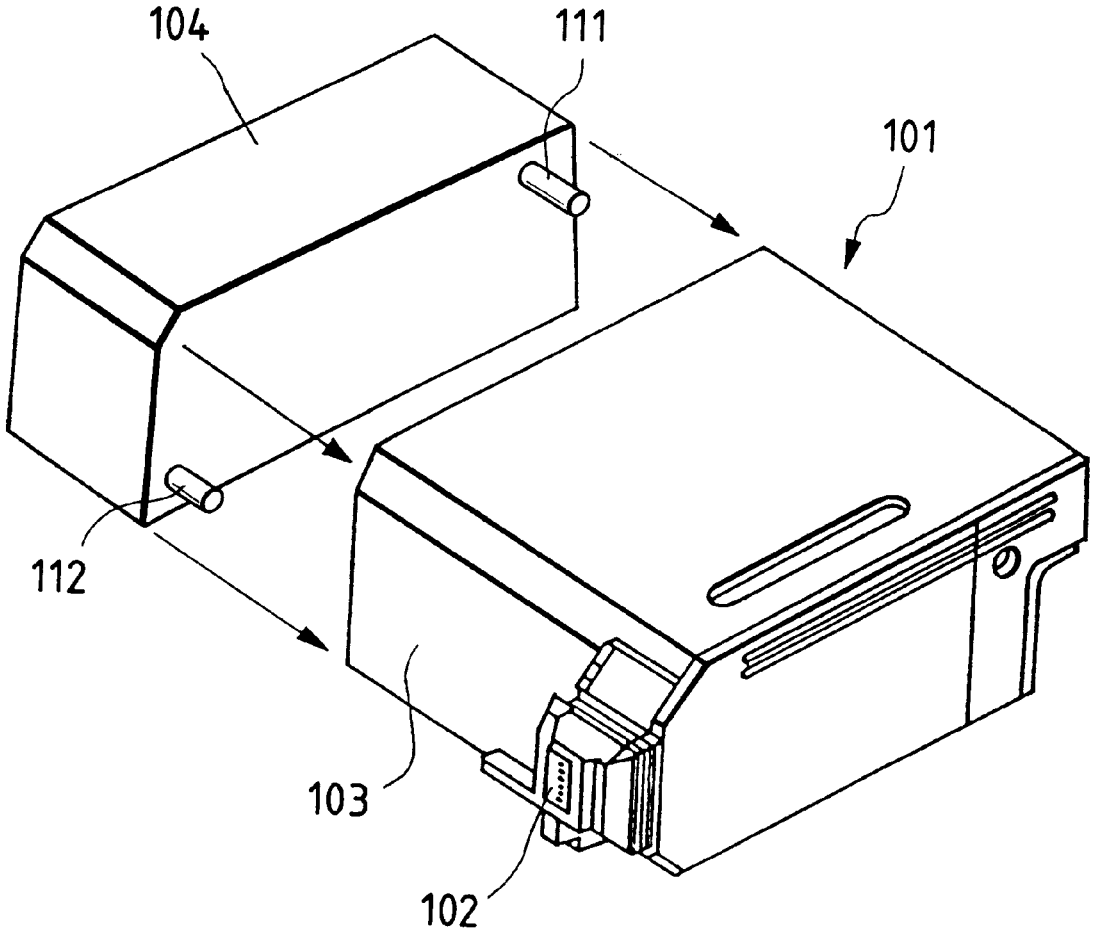
FIG. 11 is a perspective view which shows an integrated head cartridge, illustrating a fifth embodiment in accordance with the present invention.
Figure 12:
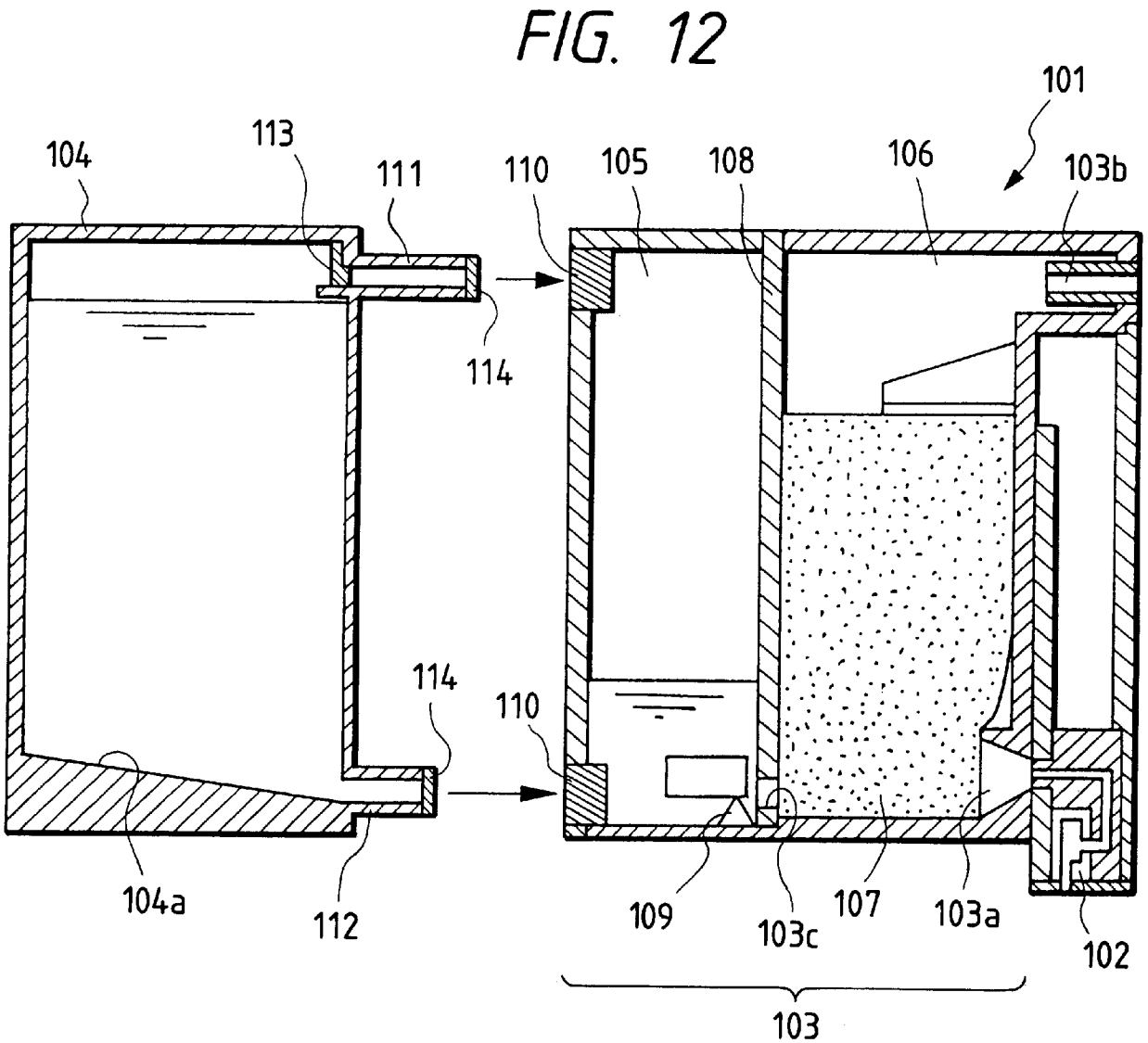
FIG. 12 is a cross-sectional view which shows the integrated head cartridge represented in FIG. 11.

FIG. 11 is a perspective view which shows an integrated head cartridge and a refilling tank to be installed therefor, illustrating a fifth embodiment in accordance with the present invention. FIG. 12 is a cross-sectional view which shows the integrated head cartridge and refilling tank represented in FIG. 11.

In accordance with the present embodiment, an integrated head cartridge 101 is formed by a recording head 102 and an ink tank 102 that holds ink to be supplied to the recording head 102, which are structured integrally at all times. Further, for this integrated head cartridge 101, a refilling tank 104 is installed to hold ink to be supplied to the ink tank 103. In this respect, the integrated head cartridge 101 is mountable on a recording apparatus in the posture shown in FIG. 11 or in FIG. 12.

Now, with reference to FIG. 12, the description will be made of the structures of the integrated head cartridge 101 and the refilling tank 104.

The interior of the ink tank 103 is divided by a partition wall, which is provided with a communicating unit 103*c*, into a negative pressure generating member housing chamber 106 that holds a negative pressure generating member 107, and an ink reserving chamber 105 that keeps ink as it is. On the wall surface that forms the negative pressure generating member housing chamber 106, an air communication port 103*b* and a supply 103*a* are formed. Ink is supplied to the recording head 102 through the supply port 103*a*. On the upper end and the lower end of the side wall of the ink reserving chamber 105, two valve members 110 are arranged for the connection with the refilling tank 104. These valve members 110 are usually closed as in the fourth embodiment. These valves are open when the air communication tube 111 and liquid communication tube 112 of the refilling tank 104 are inserted. Also, in the interior of the ink reserving chamber 105, an optical ink remain detecting sensor 109 is arranged to detect that the ink remains in the ink reserving chamber 105 become smaller.

On the side wall of the refilling tank 104, the air communication tube 111 and liquid communication tube 112 are integrally arranged corresponding to the positions of valve members 110 of the ink tank 103, respectively. The air communication tube 111 is positioned on the upper part. The liquid communication tube 112 is positioned on the lower part. Also, as shown in FIG. 11, the air communication tube 111 is positioned on the upper part, while the liquid communication tube 112, on the lower part even when the ink tank 103 and refilling tank 104 are postured in such a way as to arrange them in the horizontal direction.

The length of the air communication tube 111 is longer than that of the liquid communication tube 112. When the refilling tank 104 is installed on the ink tank 103, the air communication tube 111 is connected with the ink tank 103 earlier than the liquid communication tube 112. A water repellent film 113 that enable air to pass but not liquid is applied to the end portion of the air communication tube 111 in the refilling tank 104, thus preventing ink in the refilling tank to enter the air communication tube 111. The leading ends of the air communication tube 111 and liquid communication tube 112 are sealed by means of films 114, thus preventing ink leakage before the refilling tank 104 is installed. The films 114 are broken when the air communication tube 111 and liquid communication tube 112 are inserted into the valve members 110. The leading ends of the air communication tube 111 and liquid communication tube 112 are open. Further, the inner bottom wall of the refilling tank 104 is made a slanted surface 104 being lowered toward the liquid communication tube 112 when it is in the posture as shown in FIG. 12. With this arrangement, ink in the refilling tank 104 is guided to the liquid communication tube 112 in good condition.

When the refilling tank 104 is installed on the integrated head cartridge 101 in the horizontal direction in accordance with the structure described above, the air communication tube 111 is connected with the ink reserving chamber 105 earlier. Then the liquid communication tube 112 is connected. In this way, the pressure difference between the airs in the ink reserving chamber 105 and refilling tank 104 is adjusted. After that, ink in the refilling tank 104 is refilled into the ink reserving chamber 105. When the refilling tank 104 and ink reserving chamber 105 are completely connected, the ink reserving chamber 105 and refilling tank 104 form essentially a close space to prevent ink from overflowing from the air communication port 103*b* and the recording head 102, thus making it possible to effectuate a quick and stabilized ink refilling into the ink tank 103. Also, since the air communication tube 111 and liquid communication tube 112 are arranged with its positional relationship as described above, it is easy to execute the ink refilling in the posture shown in FIG. 11 or in FIG. 12.

When ink is refilled into the ink reserving chamber, the heights of liquid levels of ink in the refilling tank 104 and ink reserving chamber 105 are equalized. After that, the present embodiment functions the same as the ink tank 1101 described in conjunction with FIG. 15 to make it possible to effectuate a stabilized ink supply to the recording head 102.

Along with the ink consumption by the operation of the recording head 102, ink remains in the ink reserving chamber 105 and refilling tank 104 become smaller. Then, when the shortage of ink is detected by the ink remain detecting sensor 109, the refilling tank 104 is replaced with a new refilling tank, and then, ink is refilled again into the ink reserving chamber 105 as described above.

(Sixth Embodiment)

Figure 13A:
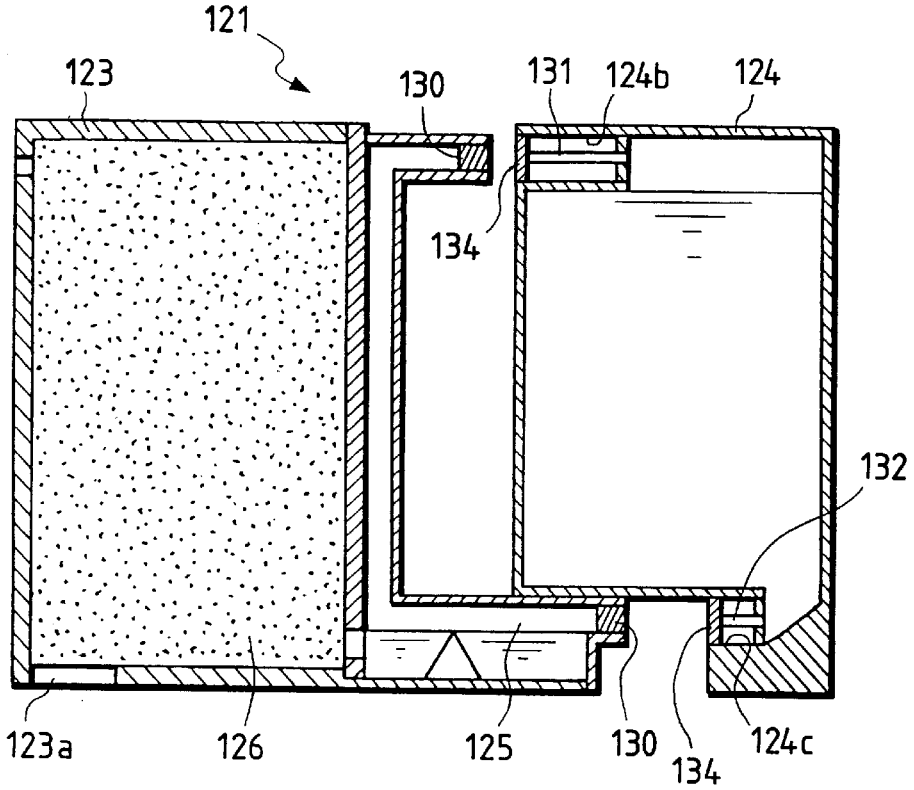
FIGS. 13A and 13B are cross-sectional views showing an integrated ink tank, illustrating a sixth embodiment in accordance with the present invention.
Figure 13B:
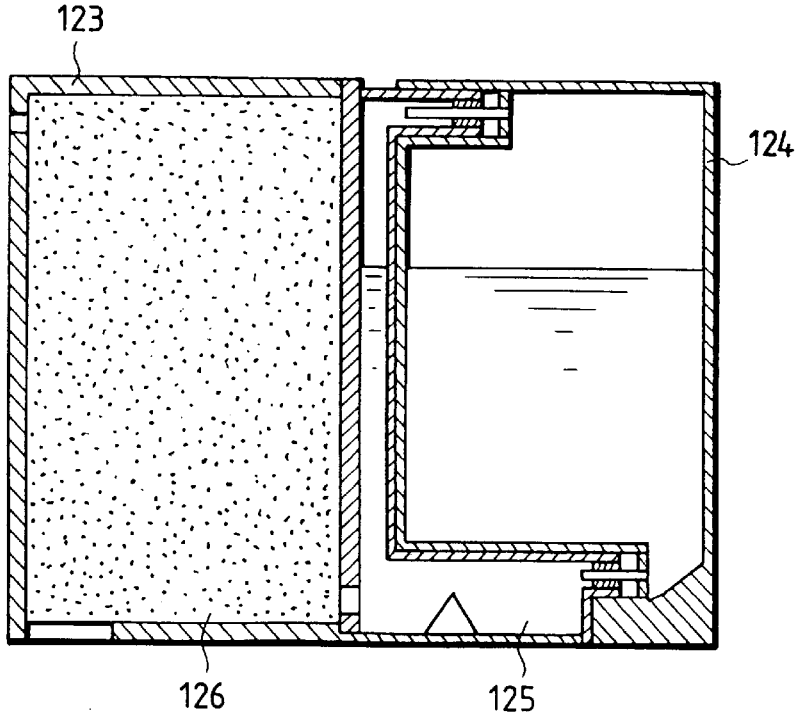

FIGS. 13A and 13B are cross-sectional views showing an integrated ink tank, illustrating a sixth embodiment in accordance with the present invention. FIG. 13A shows a state before a refilling tank is installed. FIG. 13B shows a state after the installation of the refilling tank.

In accordance with the present embodiment, an integrated ink tank 121 is arranged substantially the same as that of the fifth embodiment with the exception of the aspects that no recording head is provided for the ink tank 123; that the configuration of the ink reserving chamber 125 of the ink tank 123 is of a hook type; and that the connecting structure between the ink reserving chamber 125 and refilling tank 124 is made different. Now, hypothetically, if a recording head is installed on the supply port 123*a* formed for the negative pressure generating member housing chamber 126 of the ink tank 123, it should become the example of a variation of the fifth embodiment. In this respect, the present embodiment may also be arranged as an integrated head cartridge with the installation of a recording head, of course.

In accordance with the present embodiment, the ink reserving chamber 125 is of such a configuration that the central part thereof is scooped out in the vertical direction, and also, the portions where valve members 30 are arranged protrude to the sideward. The refilling tank 124 is configured to be fitted into the ink reserving chamber 125 of such configuration in the side way. Then, hollow needles are arranged in the concave portions 124*b* and 124*c* provided for the inner sides of the upper and lower ends of the refilling tank 124, which are inserted into the valve members 130, respectively, thus conductively connecting the ink reserving chamber 125 with the refilling tank 124.

The portions where the valve member 130 are arranged for the ink reserving chamber 125 are inserted into these concave portions 124*b* and 124*c* of the refilling tank 124 and ink tank 123, respectively. Also, the depth of the upper concave portion 124*b* is made deeper than that of the lower concave portion 124*c*. The leading ends of the needles 131 and 132 are positioned equally to the aperture ends of the concave portions 124*b* and 124*c*. Then, films 134 are applied, respectively, to the aperture ends of the concave portions 124*b* and 124*c* to seal the leading ends of the needles 131 and 132. As in the fifth embodiment, it is arranged for the present embodiment that the lengths and positions of the needles 131 and 132, and the positions of the valve members 130 are arranged so that the air in the ink reserving chamber 125 is able to communicate with the air in the refilling tank 124 earlier.

When the refilling tank 124 is installed on the ink tank 123 as shown in FIG. 13B in accordance with the structure described above, ink can be refilled from the refilling tank 124 into the ink tank 123 quickly and stably as in the fifth embodiment. After ink is refilled, the heights of liquid surfaces of ink in the refilling tank 124 and ink reserving tank 125 are equalized, making this ink tank functional the same as the ink tank 1101 described in conjunction with FIG. 15.

Further, since the refilling tank 124 is configured to fit into the ink reserving chamber 125 in accordance with the present embodiment, the refilling tank 124 can be installed reliably and smoothly. Also, the needles 131 and 132 are arranged in the concave portions 124*b* and 124*c* of the refilling tank 124, thus making it possible to prevent the damages that may be caused to the needles 131 and 132 by an external force before the installation of the refilling tank 124.

Here, in accordance with the fourth to sixth embodiments described above, it is arranged for all of them that the convex portions are provided on the refilling container side, and the concave portions are provided on the ink tank side in the unit to connect the ink tank and the refilling tank. However, it may be possible to partly or totally make the ink tank side convex.

For example, if a structure where the connecting unit on the ink tank side is made convex totally, the configuration of the refilling tank can be simplified still more. Therefore, the refilling tanks can be fabricated more easily. Also, for example, if one side of the connecting unit of the ink tank is made convex and the other, concave in its configuration, and then, the connecting unit of the refilling tank is configured corresponding to such configuration of the connecting unit of the ink tank, it becomes possible to provide a preventive measure against any wrong installation of the refilling tank on the ink tank. It is particularly preferable to apply this arrangement to an integrated ink tank, which is connected from the above when the tank is in the operating mode-as in the forth embodiment, because with this arrangement the air communication tube of the refilling tank is reliably connected in the location nearer to the partition wall side of the ink tank.

(Other Embodiments)

The embodiments of the present invention have been described so far. Hereinafter, the description will be made of various examples applicable to each of the embodiments described above. In this respect, each of the examples given below is applicable to all the embodiments described above unless otherwise specified.

<Reservoir Tank>

A reservoir tank usable for the present invention is provided with a negative pressure generating member housing chamber and an ink reserving chamber. Here, in order to enhance the strength of the ink reserving chamber, a rib is arranged for the ink reserving chamber.

Figure 14:
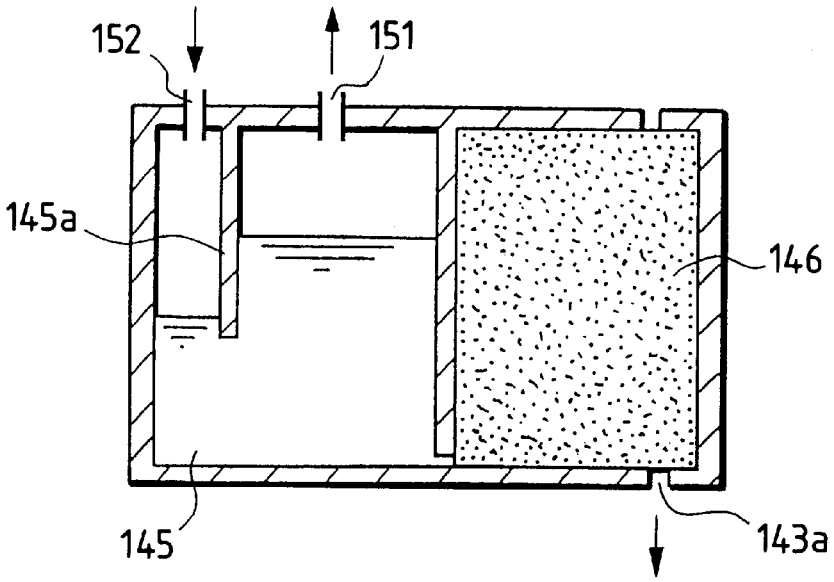
FIG. 14 is a cross-sectional view schematically showing one structural example of the reservoir tank to which the present invention is applicable.

Particularly, as shown in FIG. 14, with the provision of a rib 145*a* between the connecting unit 151 for the communication of airs themselves and the connecting unit 152 for communication of liquids themselves in the ink reserving chamber 145, which divides the liquid surface into two, there may be encountered a problem given below depending on the amount of ink to be refilled into the ink reserving chamber 145.

In other words, in such a case, ink is refilled from a refilling tank (not sown) through the connecting unit 152 for use of liquid, and then, when the liquid surface exceeds the connecting portion of the rib 145*a*, the air still remains on the side conductively connected to the connecting unit 152 for use of liquid. This event results in a phenomenon that ink is supplied to the side conductively connected to the connecting unit 151 for use of air. Therefore, when the liquid surface of the side conductively connected to the connecting unit 151 reaches the unit 151 for use of air and the liquid level of ink begins to rise by way of this unit 151, the height of the liquid surface on the other side for use of liquid makes no change any longer. As a result, the liquid surface in the negative pressure generating member housing chamber 146 is caused to rise inevitably. Once this takes place, ink in the ink refilling tank is caused to shift into the negative pressure generating member housing chamber 146 through the ink reserving chamber until an equilibrium condition is established. In the worst case, ink leaks from the supply port 143*a*.

Therefore, in order to make it difficult to raise the liquid surface on the side conductively connected to the connecting unit 151 for air use, it is preferable to make its capacity as large as possible if a rib 145*a* such as described above should be provided.

<Adjustment of Liquid Surface>

Here, in conjunction with FIGS. 2A and 2B, the supplemental description will be made of the function of liquid surface adjustment for the ink reserving chamber and the negative pressure generating member housing chamber, which is applicable to all the embodiments described above.

In a state shown in FIG. 2A, the pressure in the communicating unit 12 is substantially constant. Now, given the height of the liquid surface of the ink reserving chamber 14 as h1, the higher the liquid surface h1, the more the gaseous pressure P1 in the ink reserving chamber 14 becomes negative against the atmospheric pressure. As shown in FIG. 2B, the movement of gas and liquid takes place when it is connected with the refilling tank 5.

Now, it is assumed that the communicating unit 12 is completely closed, and that there is no conversion of gas and liquid between the ink reserving chamber 14 and the negative pressure generating member housing chamber 16. It is further assumed that in such condition, the height of the liquid surface of the ink reserving chamber 14 is h2', and the pressure in the ink reserving chamber 14 is P2'. Here, the P2' is determined by the gaseous volume, temperature, and pressure, which are present in each of the containers before a refilling operation begins.

However, in accordance with the present invention, the communicating unit 12 is not closed at all actually, and in order to balance the conditions in the negative pressure generating member housing chamber 16 and the ink reserving chamber 14, the conversion is made between gas and liquid through the communicating unit 12. Fundamentally, if the height of the liquid surface of the ink reserving chamber is h2', the gaseous pressure P in the ink reserving chamber 14 is a value to be determined by the pressure in the communicating unit 12 and the height of liquid surface h2' of the ink reserving chamber 14.

Here, the pressure P2' in the ink reserving chamber 14, which is defined on the assumption that the communicating unit 12 is closed, is not necessarily equal to the actual pressure P in the ink reserving chamber 14 to be determined by the height of liquid surface of the ink reserving chamber 14. Therefore, a minute adjustment should be made through the communicating unit 12 as given below.

For example, when the gaseous pressure in the refilling tank is equal to the atmospheric pressure before a refilling operation begins or the like, the P2' becomes greater than P if the gaseous pressure in the refilling tank 5 is higher than the gaseous pressure in the ink reserving chamber 14. As a result, a part of refilled liquid is caused to shift to the negative pressure generating member housing chamber 16 side through such minute communicating unit 12. Then, when the height of liquid surface h2 of the ink reserving chamber 14 is made lower than the height h2' lastly, the pressures P2 in the ink reserving chamber 14 and the refilling tank 5 become a specific value.

On the other hand, if the gaseous pressure in the ink reserving chamber 14 is higher than the gaseous pressure in the refilling tank 5, that is, if the P is greater than the P2', the air outside is induced from the air communication port 16*a* of the negative pressure generating member housing chamber 16, and then, it shifts to the ink reserving chamber 14 side through the communicating unit 12, thus making the pressures in the ink reserving chamber 14 and the refilling tank 5 a specific value.

Since the refilling tank 5 and the ink reserving chamber 14 form a space closed from the air outside with the exception of the communicating unit 12, such minute adjustment is possible through the communicating unit 12 thus arranged. Further, with a path for effectuating the gaseous movement, which is provided separately from the path arranged to supply liquid from the refilling tank 5 to the ink reserving chamber 14, it is made possible to make such minute adjustment smoothly.

In this respect, the operation of the minute adjustment through the communicating unit 12 as described above is not necessarily performed at the same time of the operation of refilling liquid from the refilling tank 5 into the ink reserving chamber.

Now, for example, a thought is given to the engagement between the ink reserving chamber 14 and the refilling tank 5 that may be made after ink in the ink reserving chamber is completely consumed on the assumption that there is no application of detection as to the liquid surface of the ink reserving chamber 14 by the application of the first embodiment. In this case, if the height L of the liquid surface of the negative pressure generating member housing chamber 16 becomes lower than the upper part of the air induction groove 19, and then, when the refilling tank is connected, ink is sucked into the negative pressure generating member 15 in the negative pressure generating member housing chamber 16 through the communicating unit 12, thus causing the liquid surface of the negative pressure generating member housing chamber 16 to rise. Then, because of the elevated height of the liquid surface of the negative pressure generating member housing chamber 16, the communicating unit 12 and the air induction groove 19 are covered by ink, which makes it possible to implement the method for refilling liquid of the present invention described for each of the embodiments, and to refill ink into the ink reserving chamber 14 as intended.

Also, for the refilling kits described with the fourth to sixth embodiments, the direction of ink tank to be installed is not necessarily limited to the one where it is installed on the lower side of the direction of the gravity of the minute communicating unit. Now, a thought is given to a case where ink in the refilling tank is refilled into the ink reserving chamber in a state that the minute communicating unit resides on the upper side of the direction of gravity. Then, unless the meniscus of the minute communicating unit is broken during the operation of refilling ink from the refilling tank into the ink reserving chamber, the refilling operation itself is executable. If the minute communicating unit should be placed on the lower side with respect to the direction of the gravity when it is in use or the like, the minute adjustment is effectuated through the communicating unit as described above. Therefore, for the refilling kits described in accordance with the fourth to sixth embodiments, the direction of the ink tank installation should be good enough if only it makes the refilling operation of ink possible from the refilling tank into the ink reserving chamber.

<Remainder Detection>

For each of the embodiments of the present invention, a remainder detection mechanism that utilizes electrodes or optics is provided unexceptionally. However, with the exception of the second embodiment, such remainder detection mechanism is not necessarily considered to be a constituent of the present invention.

In other words, as referred to in the paragraphs that describe the minute adjustment of liquid surface, if the connection is assumed to have been made after ink in the ink reserving chamber is completely consumed without detecting the liquid surface of the ink reserving chamber, ink is absorbed into the negative pressure generating member in the negative pressure generating member housing chamber through the communicating unit before the liquid surface of the ink reserving chamber is raised until the communicating unit becomes the closed space in operating the refilling operation. In this case, it is preferable to provide an air induction groove in the vicinity of the communicating unit as in the first embodiment so that there is no possibility that a sufficient amount of ink resides between the communicating unit and the ink supply port.

Further, in consideration of the event that there is no sufficient ink residing between the communicating unit and the ink supply port, it is preferable to execute the recovery operation for the recording head unit.

On the other hand, if a remainder detection mechanism is provided, there is an advantage that the execution of such recovery operation is not needed. Therefore, a remainder detection mechanism should be designed as the case may be. Also, it may be possible to form the ink reserving chamber of the refilling tank or the reservoir tank (an ink tank in case of the integrated ink tank) with a transparent material so that the refilling timing is made recognizable by means of observation using eye-sight.

Here, for the second embodiment, the liquid surface detection mechanism is an essential constituent in order to prevent any unprepared supply of ink from the main tube installed on the refilling tank. However, it may be possible to refill ink from the refilling tank after the ink in the ink reserving chamber is completely consumed if only an arrangement is made so that the ink reserving chamber of the ink tank and the refilling tank is not conductively connected when recording is operated.

Also, for the present invention, the description has been made adopting ink as the liquid to be used. However, the usable liquid is not limited thereto. The present invention is of course applicable to use of a liquid for processing ink, and other liquids for use of recording.

As described above, when liquid is refilled from a refilling container into a liquid reserving container having first and second chambers in accordance with the present invention, the liquid surface of the refilling container is positioned higher than that of the second chamber. Therefore, while an essentially closed space is being formed by means of the second chamber of the liquid reserving container and the second chamber, the liquid reserving container and the refilling container are connected by means of a first path for enabling gases in both of them to be communicated, and a second path, which is different from the first path, hence making it possible to refill liquid quickly without leakage of liquid from the aperture of the first chamber even if there is a slight difference in pressure between them. Particularly, with an arrangement for enabling the second path to be connected subsequent to the connection of the first path, it is possible to effectuate a stabilized liquid refilling even if there is a large difference in pressure between the second chamber and the refilling container.

What is claimed is:

1. A method for refilling liquid using a refilling container to refill liquid to a liquid reserving container provided with a first chamber housing a negative pressure generating member and having an opening communicating with atmospheric air, and a second chamber communicating with said first chamber through a communicating portion to form essentially a closed space with the exception of said communicating portion, comprising the steps of:

forming an essentially closed space from the atmospheric air by said second chamber and said refilling container with the exception of said communicating portion in a state of the liquid surface of said refilling container being positioned higher than the liquid surface of said second chamber; and arranging said second chamber to be connected with said refilling container by a first path for conducting gas in said second chamber into said refilling container, and by a second path different from said first path for conducting liquid in said refilling container into said second chamber, and said first path is positioned above said second path.

2. A method for refilling liquid according to claim 1, wherein said second path is connected after said first path is conductively connected.

3. A method for refilling liquid according to claim 1, wherein said second chamber is connected with said refilling container being in a state of said communicating portion to be positioned on a bottom side thereof.

4. A method according to claim 1, wherein said first path is arranged such that the gas in the second chamber is able to communicate with gas in the refilling container.

5. A liquid jet recording apparatus provided with a head cartridge having a liquid reserving container holding liquid, and a recording head for recording on a recording medium by discharging liquid to be supplied from said liquid reserving container, and with a refilling container holding liquid to be refilled into said liquid reserving container, comprising:

said liquid reserving container having a first chamber housing a negative pressure generating member and having a supply port for supplying liquid to said recording head and an air communication port, and a second chamber having a communicating portion communicating with said first chamber to make essentially a closed space with the exception of said communicating portion; and said second chamber and said refilling container being connected in a state of the liquid surface of said refilling container being positioned higher than the liquid surface of said second chamber by a first path for conducting gas in said second chamber into said refilling container and a second path different from said first path for conducting liquid in said refilling container to said second chamber, and said first path is positioned above said second path.

6. A liquid jet recording apparatus according to claim 5, wherein a capacity of said refilling container is larger than a capacity of said liquid reserving container.

7. A liquid jet recording apparatus according to claim 5, wherein said first path and said second path are comprised of tubes connected with said second chamber and said refilling container, and provided with valves, respectively.

8. A liquid jet recording apparatus according to claim 5, wherein said first path and said second path are structured by tubes provided for said refilling container and said second chamber, and valve mechanisms arranged for said tubes, respectively, and the tube provided for said refilling container and tube for said second chamber are connected by the movement of a carriage, and said valve mechanism are open by the connections of said tubes.

9. A liquid jet recording apparatus according to claim 8, wherein the tubes constituting said first path are connected earlier than the tubes constituting said second path.

10. A liquid jet recording apparatus according to claim 5, wherein means for detecting ink remains is provided for said liquid reserving container to detect the height of the liquid surface in said second chamber, and when the liquid surface in said second chamber becomes a specific height, the connection between said second chamber and said refilling container through said first path and said second path is cut off.

11. A liquid jet recording apparatus according to claim 5, wherein said second chamber and said refilling container are connected substantially in the horizontal direction, and said first path is positioned above said second path.

12. A liquid jet recording apparatus according to claim 5, wherein said first path is arranged such that the gas in the second chamber is able to communicate with gas in the refilling container.

13. A liquid refilling container detachably installed on a liquid reserving container provided with a first chamber housing a negative pressure generating member and having an opening communicating with the atmospheric air, and a second chamber communicating with said first chamber through a communicating portion for forming essentially a closed space with the exception of said communicating portion, comprising:

a first path for conducting gas to said refilling container; and a second path different from said first path for conducting liquid in said liquid refilling container to said second chamber, wherein an opening of said container of said first path is positioned above that of said container of said second path.

14. A liquid refilling container according to claim 13, wherein said liquid refilling container is connected with said second chamber substantially in the horizontal direction.

15. A liquid refilling container according to claim 13, wherein said refilling container is connected with said second chamber in a state of said communicating portion being positioned on the bottom side of said liquid reserving container.

16. A liquid refilling container according to claim 13, wherein said first path is arranged such that the gas in the second chamber is able to communicate with gas in the refilling container.

17. A liquid reserving container for liquid in a liquid refilling container to be refilled thereinto when said liquid refilling container holding liquid therein is installed, comprising:

a first chamber housing a negative pressure generating member and having an opening communicating with atmospheric air;

a second chamber having a communicating portion communicating with said first chamber for forming essentially a closed space with the exception of said communicating portion;

a first connecting unit provided for said second chamber for the connection with said first path provided for said liquid refilling container to conduct gas in said second chamber to said refilling container;

a second connecting unit provided for said second chamber different from said first connecting unit for the connection with the second path provided for said liquid refilling container for conducting liquid in said liquid refilling container to said second chamber; and valve members provided respectively for said first and second connecting units and arranged to be open when said first path or second path is connected.

18. A head cartridge integrally formed by a liquid reserving container according to claim 17 and a recording head for recording by discharging liquid onto a recording medium to be supplied from the first chamber of said liquid reserving container.

19. A liquid reserving container according to claim 17, wherein said first path is arranged such that the gas in the second chamber is able to communicate with gas in the refilling container.

20. An integrated liquid container, comprising:

a liquid reserving container provided with a first chamber housing a negative pressure generating member and having an opening communicating with the atmospheric air, and a second chamber communicating with said first chamber through a communicating portion for forming essentially a closed space with the exception of said communicating portion; and a liquid refilling container detachably mountable on said liquid reserving container for refilling liquid held therein into said liquid reserving container, wherein said liquid refilling container is provided with a first path for conducting gas in said second chamber to said liquid refilling container, and a second path different from said first path for conducting liquid in said liquid reserving container to said second chamber, said first path being above said second path; and wherein said liquid reserving container is provided with a first connecting unit arranged for said second chamber for the connection with said first path, a second connecting unit different from said first connecting unit arranged for said second chamber for the connection with said second path, and valve mechanisms provided respectively for said first and second connecting units and arranged to be open when said first path or said second path is connected.

21. An integrated liquid container according to claim 20, wherein said first path is arranged such that the gas in the second chamber is able to communicate with gas in the liquid refilling container.

22. An integrated head cartridge, comprising:

a liquid reserving container provided with a first chamber housing a negative pressure generating member and having an opening communicating with the atmospheric air, and a second chamber communicating with said first chamber through a communicating portion for forming essentially a closed space with the exception of said communicating portion;

a liquid refilling container detachably mountable on said liquid reserving container for refilling liquid held therein into said liquid reserving container; and a recording head for recording by discharging liquid onto a recording medium to be supplied from the first chamber of said liquid reserving container, wherein said liquid refilling container is provided with a first path for conducting gas in said second chamber to said liquid refilling container, and a second path different from said first path for conducting liquid in said liquid reserving container to said second chamber, said first path being above said second path; and wherein said liquid reserving container is provided with a first connecting unit arranged for said second chamber for the connection with said first path, a second connecting unit different from said first connecting unit arranged for said second chamber for the connection with said second path, and valve mechanisms provided respectively for said first and second connecting units and arranged to be open when said first path or said second path is connected.

23. An integrated head cartridge according to claim 17, wherein said first path is arranged such that the gas in the second chamber is able to communicate with gas in the liquid refilling container.

* * * * *